US012194331B2

(12) United States Patent
O'Connor

(10) Patent No.: US 12,194,331 B2
(45) Date of Patent: Jan. 14, 2025

(54) WEIGHTLIFTING APPARATUS WITH DYNAMIC ASSIST

(71) Applicant: Christopher S. O'Connor, Livonia, MI (US)

(72) Inventor: Christopher S. O'Connor, Livonia, MI (US)

( * ) Notice: Subject to any disclaimer, the term of this patent is extended or adjusted under 35 U.S.C. 154(b) by 181 days.

(21) Appl. No.: 17/657,794

(22) Filed: Apr. 4, 2022

(65) Prior Publication Data

US 2022/0323812 A1 Oct. 13, 2022

Related U.S. Application Data

(60) Provisional application No. 63/173,105, filed on Apr. 9, 2021.

(51) Int. Cl.

| | |
|---|---|
| ***A63B 21/00*** | (2006.01) |
| ***A63B 21/072*** | (2006.01) |
| ***A63B 21/078*** | (2006.01) |
| ***A63B 24/00*** | (2006.01) |

(52) U.S. Cl.

CPC .... *A63B 21/00181* (2013.01); *A63B 21/0724* (2013.01); *A63B 21/078* (2013.01); *A63B 24/0062* (2013.01); *A63B 2024/0093* (2013.01); *A63B 2220/13* (2013.01)

(58) Field of Classification Search

CPC ..... A63B 21/00181; A63B 21/0724; A63B 21/078; A63B 24/0062; A63B 2024/0093; A63B 2220/13; A63B 17/00; A63B 2230/605; A63B 24/0087; A63B 2225/20; A63B 21/0783; A63B 21/0058; A63B 2071/0627; A63B 2071/068; A63B 2220/40; A63B 2225/50; A63B 2230/062

See application file for complete search history.

(56) References Cited

U.S. PATENT DOCUMENTS

| | | | | | |
|---|---|---|---|---|---|
| 4,574,789 | A | * | 3/1986 | Forster | A61H 1/0218 248/327 |
| 4,836,535 | A | * | 6/1989 | Pearson | A63B 21/154 482/106 |
| 4,949,959 | A | * | 8/1990 | Stevens | A63B 21/4029 482/104 |
| 4,998,721 | A | * | 3/1991 | Anders | A63B 21/0783 482/4 |
| 5,048,826 | A | * | 9/1991 | Ryan | A63B 21/00181 482/7 |
| 5,190,510 | A | * | 3/1993 | Goodger | A63B 21/4029 482/104 |
| D345,999 | S | * | 4/1994 | Adkins | D21/675 |

(Continued)

*Primary Examiner* — Garrett K Atkinson
(74) *Attorney, Agent, or Firm* — Bejin Bieneman PLC

(57) ABSTRACT

A weight training apparatus includes an electrical hoist and a cable coupled to the electrical hoist. A first end of the cable is coupled to the electrical hoist and a second end is configured to attach to a barbell assembly. A sensor is configured to output a signal indicative of a lift position of the barbell assembly. A controller is programmed to compare the lift position to an predetermined vertical locations and activate the electrical hoist to change the lift position of the barbell assembly based at least in part on at least one of the lift position or vertical lift velocity relative to the predetermined vertical locations.

20 Claims, 13 Drawing Sheets

(56) References Cited

U.S. PATENT DOCUMENTS 5,310,394 A * 5/1994 Kallios ..... A63B 21/00181 482/93
5,314,394 A * 5/1994 Ronan ..... A63B 21/0626 482/1
5,407,403 A * 4/1995 Coleman ..... A63B 21/078 482/104
5,989,164 A * 11/1999 Kullman ..... A63B 21/078 482/93
6,293,892 B1 * 9/2001 Slawinski ..... A63B 21/152 482/4
6,379,287 B1 * 4/2002 Slawinski ..... A63B 21/0783 482/4
6,893,381 B2 * 5/2005 Slawinski ..... A63B 21/0783 482/4
6,926,648 B2 * 8/2005 Capizzo ..... A63B 21/4029 482/106
6,926,649 B2 * 8/2005 Slawinski ..... A63B 21/0783 482/106
7,163,488 B2 * 1/2007 Anders ..... A63B 21/0724 482/4
7,819,785 B2 * 10/2010 Maiaro ..... A63B 21/0626 482/4
7,963,886 B1 * 6/2011 Schwinn ..... A63B 21/0783 482/99
8,727,946 B2 * 5/2014 Greenhill ..... A63B 21/0626 482/9
8,900,097 B1 * 12/2014 Griggs ..... A63B 21/4043 482/4
9,993,710 B1 * 6/2018 McCoy ..... A63B 67/10
10,265,581 B2 4/2019 O'Connor
10,456,614 B1 * 10/2019 Dube ..... A63B 24/0062
10,478,659 B2 * 11/2019 O'Connor ..... A63B 21/159
10,881,894 B2 * 1/2021 Davis ..... A63B 23/03525
10,926,125 B1 * 2/2021 Candler ..... A63B 21/08
2004/0176224 A1 * 9/2004 Slawinski ..... G05F 1/45 482/93
2004/0192519 A1 * 9/2004 Slawinski ..... A63B 21/0783 482/99
2005/0233871 A1 * 10/2005 Anders ..... A63B 21/078 482/8
2006/0148624 A1 * 7/2006 Bae ..... A63B 21/078 482/93
2007/0179030 A1 * 8/2007 Slawinski ..... A63B 21/0724 482/99
2009/0233769 A1 * 9/2009 Pryor ..... G16H 20/30 482/8
2009/0312162 A1 * 12/2009 Maiaro ..... A63B 21/078 482/104
2012/0244999 A1 * 9/2012 Tauriainen ..... A63B 21/078 482/104
2013/0190143 A1 * 7/2013 Greenhill ..... A63B 21/00181 482/104
2018/0200562 A1 * 7/2018 Nesbit ..... A63B 21/0783
2020/0376321 A1 * 12/2020 Davis ..... A63B 21/0058

* cited by examiner

WEIGHTLIFTING APPARATUS WITH DYNAMIC ASSIST

CROSS-REFERENCE TO RELATED APPLICATIONS

This application claims the benefit of US Provisional Patent Application No. 63/173,105 filed on Apr. 9, 2021 and titled "WEIGHTLIFTING APPARATUS WITH DYNAMIC ASSIST", the content of which is hereby incorporated by reference in its entirety.

BACKGROUND

Weight training allows a user to train various muscles in the body. During a weight training session, a user performs repetitions of various exercises using an appropriate weight. The user performs the repetitions until fatigue sets in, typically stopping within 3 repetitions of failure. If the user is attempting to lift a higher amount of weight than usual, lift to total failure (e.g., until the user cannot perform any more repetitions with sufficient form), or otherwise perform an action that could cause injury if done improperly, the user may ask a spotter to help the user complete the lift, if necessary. The spotter positions themself near the user and can help the user complete the lift and/or rerack the weight should the user become unable to complete a repetition.

DETAILED DESCRIPTION

Figure 1:
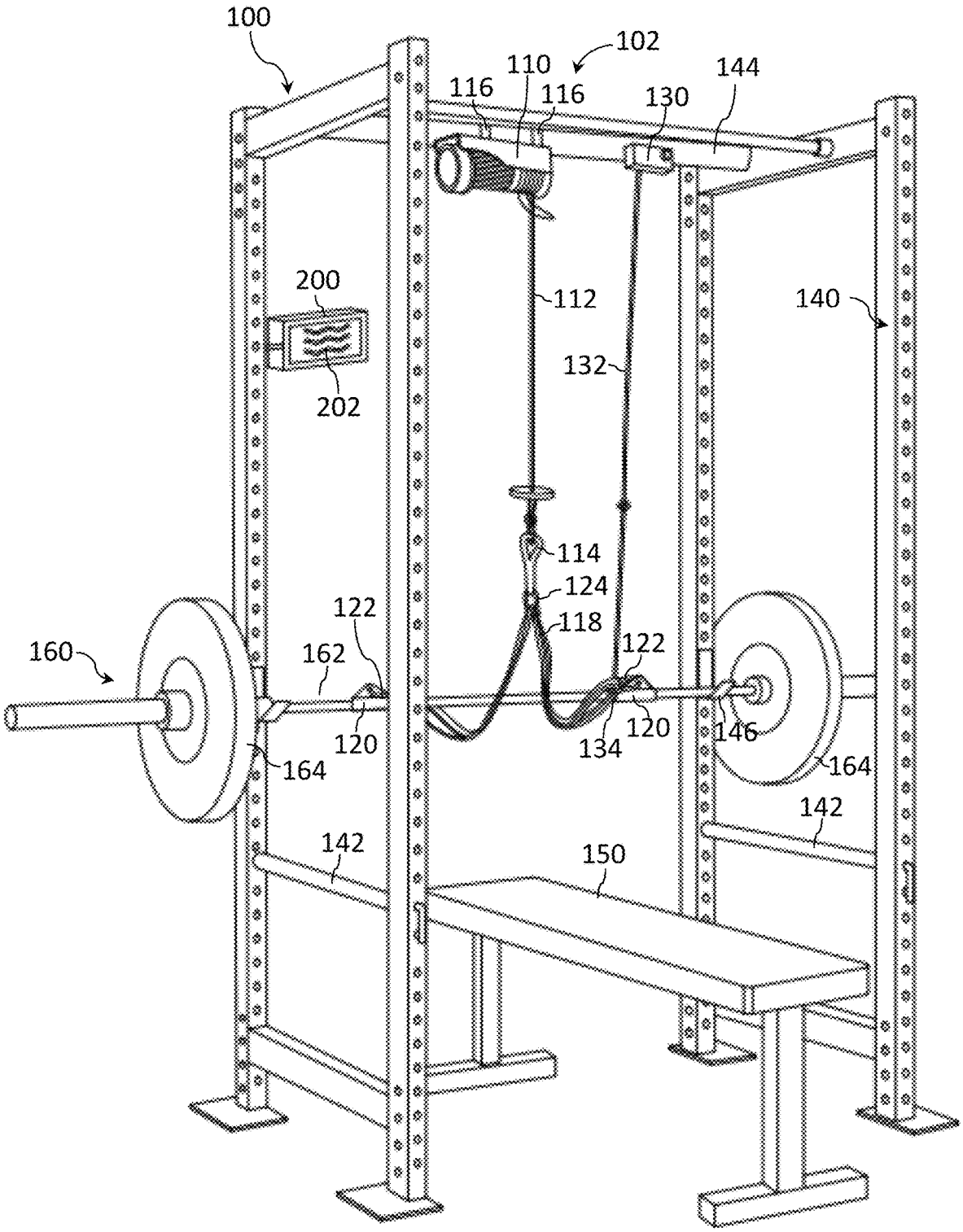
FIG. 1 is a front oblique view of a bench press apparatus in a power rack with electrical lift assist device extended.

An issue that may occur during a weight training session is the onset of muscle fatigue leading to a person being unable to complete a set of repetitions. It is commonly accepted that maximum muscle growth occurs during the last few repetitions of the set when the muscle is fully exhausted. The ability to assist the user in real time during a set allows the user to continue deeper into the muscular exhaustion and growth. A person lifting weights may enlist the aid of a spotter (e.g., another person) to help lift or hold the weight when muscle fatigue sets in.

A spotter, however, is not always available. For instance, the person lifting weights may not know anybody else at the gym well enough to ask for a spot. Moreover, the person may be lifting weights in a home gym where no spotters are available. In such instances, the person lifting weights may turn to weight training assistance systems, which allow the user to train various muscles in the body by providing assistance when needed. A weight training assistance system may be configured to assist during various strength exercises. For example, a weight training assistance system may be designed for exercises for the chest muscles or leg muscles. Weight training assistance systems may include winches, servo motors, stepper motors, electric motors, hydraulic actuators, pneumatic actuators, counter-mass systems to provide the assistance. Many of these systems are manually operated by the user and, as such, do not rely on an electronic controller.

One way to improve upon existing weight training assistance systems is with a weight training apparatus and system that can detect user fatigue and provide a spotter function to provide assistance when fatigue is detected by the system. The system described herein can also vary the assistance during an exercises session to provide a more varied workout. The system may also be adapted to different weight training devices that may target different muscles.

The weightlifting assist system disclosed herein is configured to provide an electronic feedback loop to automatically vary the assistance based on real-time measurements including speed of the lift, stall detection, total repetitions, force applied, and/or energy exerted. A common performance metric for weight trainers is the number of exercise cycles, iterations, or repetitions (or 'reps') expressed as a discrete integer. These discrete integer performance metrics make it difficult for the user to observe progress over a short term. For example, the number of exercise cycles does not consider the resistance level during the exercise cycle. The system described herein is also configured to calculate the average force, energy, and power lifted over the set to provide a continuous performance metric. Such a continuous performance metric provides a better indication of progress than the number of exercise cycles.

Given the ability to collect multiple performance metrics, including the number of repetitions performed without assistance, the number of repetitions performed with assistance, the time duration of the set, the weight of the lift and the weight of the user, estimates can be provided to the user on the likelihood of muscle growth and strength increase. Also, based on the measured metrics, specialized coaching statement can be provided to guide the user for future exercise cycles.

The elements shown may take many different forms and include multiple and/or alternate components and facilities. The example components illustrated are not intended to be limiting. Indeed, additional or alternative components and/or implementations may be used. Further, the elements shown are not necessarily drawn to scale unless explicitly stated as such.

Figure 2:
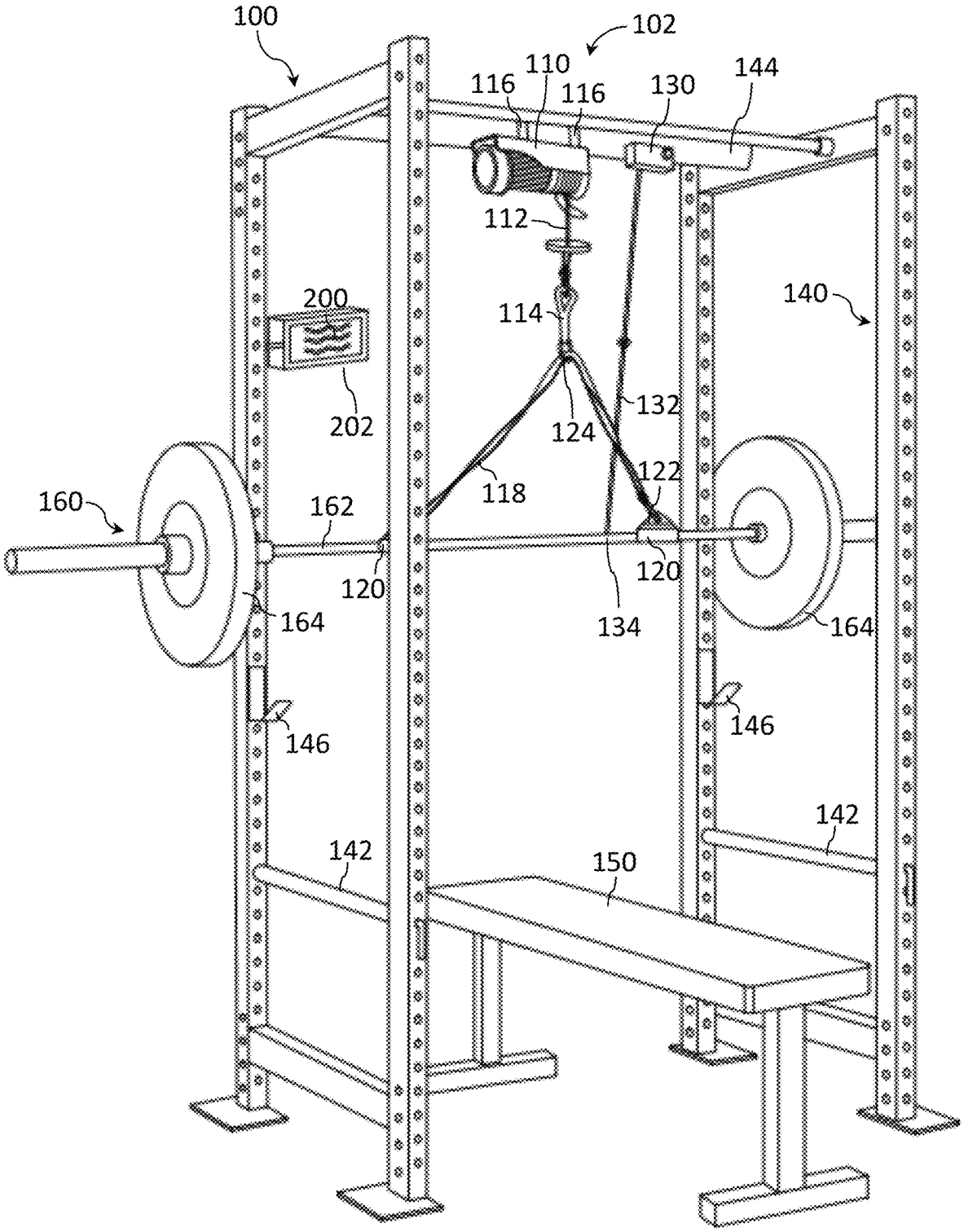
FIG. 2 is a front oblique view of a bench press apparatus in a power rack with electrical lift assist device retracted.

FIGS. 1-2 depict different views of one possible configuration of the electrical lift assist apparatus 100 in the form of a bench press apparatus in a power rack 140. The bench press apparatus in a power rack 140 may include an electrical hoist 110, sensor 130, barbell assembly 160, a controller 200 and a user interface 202. FIG. 1 depicts a view of the apparatus 100 at the bottom of a repetition or a resting state with the electrical lift assist device 102 in a maximum extension or full load state. FIG. 2 depicts a view of the apparatus 100 at a top of a repetition with the electrical lift assist device 102 in the retracted state used for providing assistance.

Figure 3:
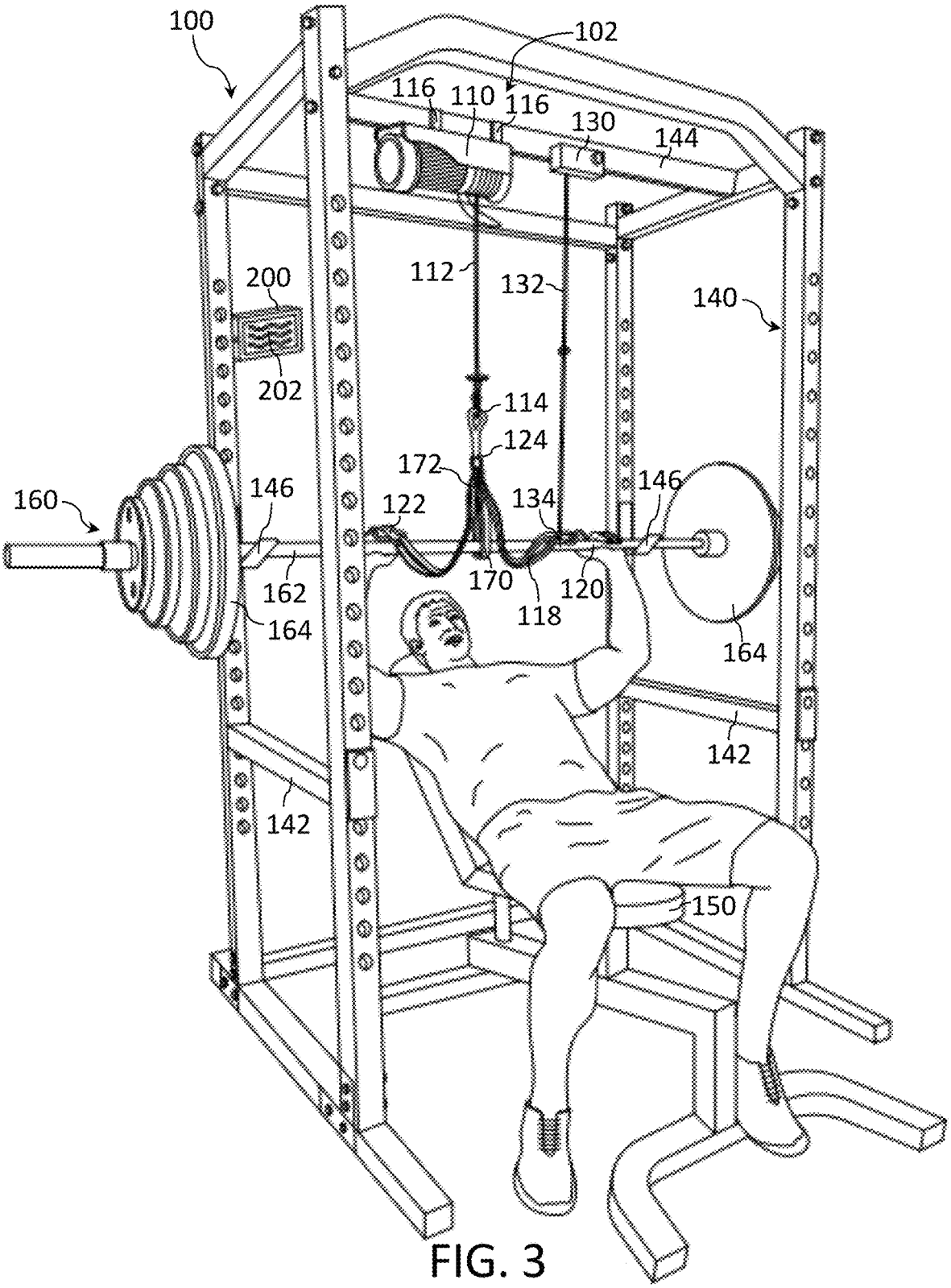
FIG. 3 is a front oblique view of an incline bench press in a power rack with electrical lift assist device extended at a resting position.
Figure 4:
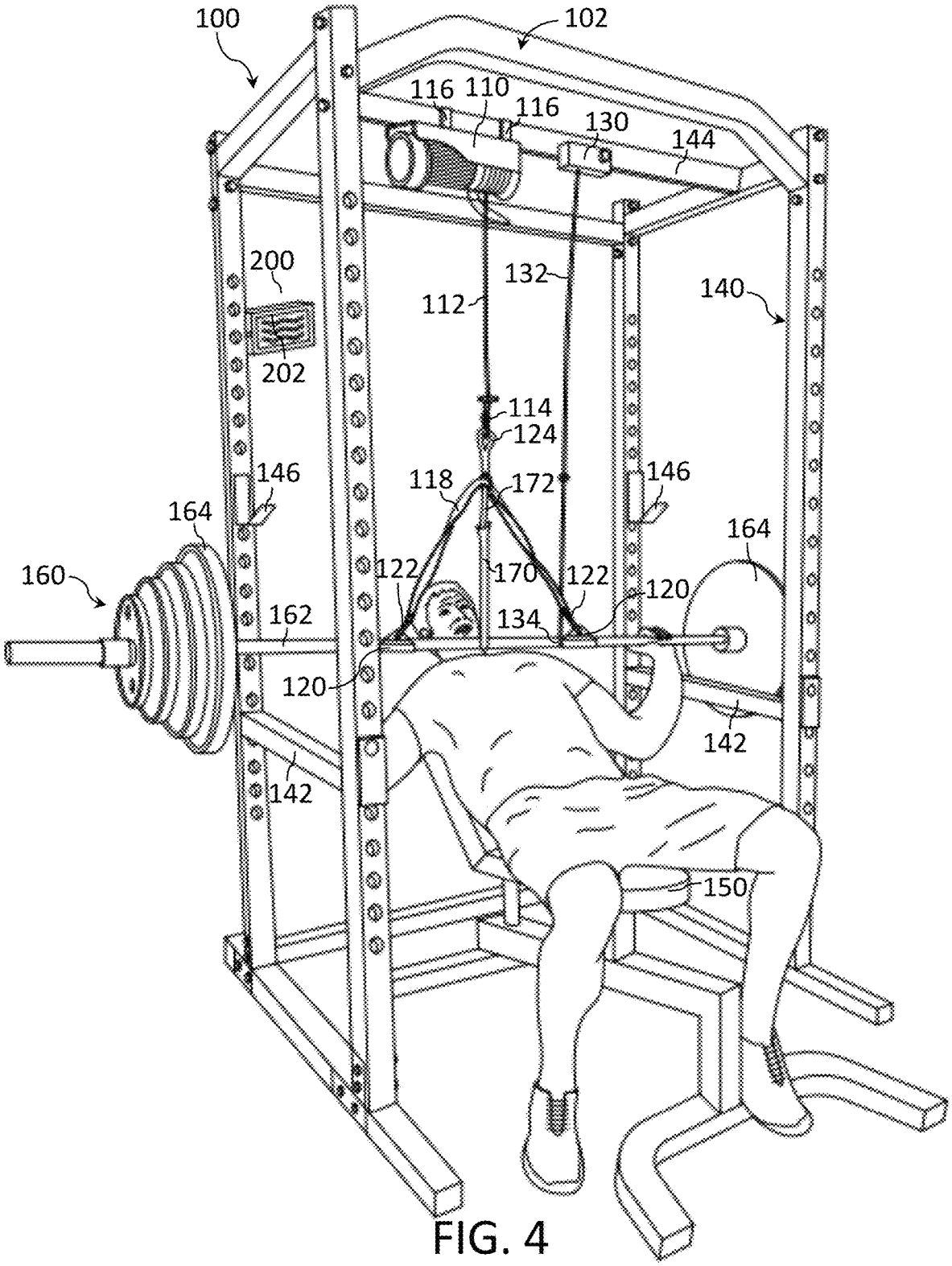
FIG. 4 is a front oblique view of an incline bench press in a power rack with electrical lift assist device extended at bottom of repetition.

FIGS. 3-4 depict different views of another possible configuration of the electrical lift assist apparatus 100 in the form of an incline bench press apparatus in a power rack 140 with a user. The incline bench press apparatus in a power rack 140 may include an electrical hoist 110, sensor 130, barbell assembly 160, a controller 200 and a user interface 202. An alternative elastic member 170 may be included. FIG. 3 depicts a view of the apparatus 100 at the resting state with the electrical lift assist device 102 in a maximum extension or full load state and the elastic member 170 in the slack state. FIG. 4 depicts a view of the apparatus 100 at a bottom of a repetition with the electrical lift assist device 102 in the extended state and the elastic member 170 in the stretched position.

Referencing FIGS. 1-4, the electrical lift assist device 102 may include an electrical hoist 110, sensor 130, barbell assembly 160, a controller 200 and a user interface 202. The electrical hoist 110 may have a hoist cable 112 that is coupled at the distal end to a hoist cable hook 114. The hoist cable hook 114 may be coupled to one or more tension-only members such as one or more semi-rigid straps 118. The semi-rigid straps 118 may be made of, but not limited to, a strong fabric or nylon weave. The semi-rigid straps 118 would be strong in tension but have minimal strength in compression to allow the barbell bar 162 to move upwards against them without contributing to the resistance offered by the barbell bar 162. The hoist cable hook 114 may optionally be attached to one or more connecting rings 124 before coupling to the semi-rigid straps 118. One purpose of these connecting rings 124 is to adapt to various attachment hook sizes and allow for additional attachments.

The semi-rigid straps 118 may be coupled to carabiner hooks or threaded chain quick links 122 on the distal end. The attachments of the semi-rigid straps 118 may be in pairs to provide stability to the barbell bar 162 when lifted and reduce barbell bar 162 tilting. The carabiner hooks 122 may be coupled to the bar sleeves 120 through holes provided in the bar sleeves 120. The bar sleeves 120 may then fit securely on the barbell bar 162. The bar sleeves 120 may fit concentrically over the barbell bar 162, with for example, set screws to secure the sleeves 120 from sliding on the barbell bar 162. In this example, the barbell bar 162 is a part of the barbell assembly 160. This barbell assembly 160 may also include a multiplicity of weight plates 164, attached concentrically to the barbell bar 162 at its ends.

Another type of tension-only member, such as an elastic member 170, may also be connected between the hoist hook 114 and the barbell bar 162. The elastic member 170 may be, but not limited to, an elastic band, a spring, or a rubber bungee cord. The elastic member 170 may be coupled to the hoist hook 114 through a clip 172 and looped around the barbell bar 162. Other direct attachment methods of the elastic member 170 to the barbell bar 162 may also be possible. The elastic member 170 may be installed so as to be slack until a predefined amount of upward hoist cable 112 movement, at which time the elastic member 170 would counter the downward force of the barbell mass. The elastic member 170 may be installed in parallel to the semi-rigid straps 118 or in place of the tension-only straps.

The electrical lift assist apparatus 100 may further include a sensor 130 for measuring the generally vertical movement of the barbell assembly 160. This sensor 130 may be capable of measuring translational distance and may be, but not limited to, a string potentiometer, an ultrasonic distance measurement device, a linear variable differential transformer (LVDT), or an accelerometer array. The sensor 130 may be coupled to the rack cross member 144 on the upper end. The sensor 130 may then be coupled to the barbell bar 162 at the lower end. For example, the sensor 130 may be a string potentiometer. The string potentiometer may have a cord 132 that extends downwards towards the barbell bar 162. The string potentiometer cord 132 may couple to the barbell bar 162 through a cord attachment 134.

As the barbell bar 162 moves through its motion, the sensor 130 measures and relays the location to the electronic control unit (ECU) 200. The sensor may also be electrically coupled to the controller 200. This electrical connection may be through conductive wire or through a wireless approach. The controller 200 processes the movement of the barbell bar 162 and provides electrical control to the electrical hoist 110.

The output of the sensor 130 provides a signal indicative of the generally vertical position of the barbell assembly 160. The vertical position may be a position relative to the resting position and may be referred to as a lift position. Further, a speed of lift may also be derived from the position signal. By differentiating the position signal a linear velocity of the barbell assembly 160 may be computed. In addition, a derivative of the linear velocity provides a linear acceleration of the barbell assembly 160. The position, velocity, and acceleration values may be used to control operation of the electrical hoist 110. The controller 200 receiving the output signal of the motion sensor 130 may be programmed to compute the position, velocity, and acceleration values. A starting position of a repetition may be a position that is above the resting position of the barbell assembly 160. Learning a starting position may begin when the position changes from the resting position of the barbell assembly 160. For some configurations, the starting position of the repetition may be the same as the resting position of the barbell assembly 160. An alternative method of estimating the linear velocity of the barbell assembly 160, without the noise inherent in numerical differentiation, is to monitor the displacement over a fixed time interval to determine if the velocity exceeds a predetermined threshold.

For example, when the motion sensor 130 is a string potentiometer, the electrical resistance of the potentiometer varies as the barbell assembly 160 moves. The resistance value may be indicative of the relative vertical location of the barbell assembly 160 from the rest position. The rest position may be the position in which the barbell assembly 160 is in a position resting on the power rack rest supports 146. By measuring the resistance value, the location of the barbell assembly 160 may be determined. A calibration procedure may be utilized to calibrate the resistance values for a given range of locations. The potentiometer may have three electrical connections. A predetermined voltage may be applied across first and second electrical connections. An output signal may be provided by the third electrical connection that has a voltage that varies as the resistance changes during movement. The output signal may be input to the controller 200.

The electrical hoist 110 may be electrically coupled to the controller 200 through conductive wire. The electrical hoist 110 may be, but not limited to, an A/C driven hoist operating at 120V or 240V. The hoist 110 may be, but not limited to, commercially available with load capacities ranging from 440 lb to 1000 lb. This capacity would be reasonable for most lift assistance for humans. The hoist 110 may be operated with a single cable 112 or a double cable attached securely back up to the hoist 110 for a doubled load capacity. The lift speed of the hoist 110 may, for example, be 33 feet per minute. The controller 200 may be configured to send a voltage to the electrical hoist 110 to cause the hoist 110 to retract and raise the hoist cable 112. The controller 200 may also be configured to send a reversed voltage to the electrical hoist 110 to cause the hoist 110 to extend and lower the hoist cable 112. The microcontroller in the controller 200 may use logical statements to perform a multiplicity of movements of the hoist 110.

The controller 200 may be configured to receive input from the sensor 130, as well as a user interface 202 and an internal microphone 216 for receiving audible commands. This may enable an audible 'help' command that actuates the hoist to assist the user based on their verbal cues. The controller 200 may be configured to provide output to the hoist 110, as well as the user interface 202 for displaying instructions, performance metrics and coaching guidance. The controller 200 may additionally output to a sounder for providing audible cues and to a wireless interface. The sounder may be, but not limited to, a chime, buzzer or speaker. The controller 200 may include a microcontroller and a hoist control module for controlling and sending electrical signals. The controller 200 may be powered by an electrical power source including but not limited to, a battery or low voltage power supply.

The user interface 202 may be, but not limited to, a thin-film-transistor liquid-crystal display (TFT-LCD) that may receive input from the user and provide output back to the user. The user interface 202 may be a touch screen for receiving input. Also, the user interface 202 may be a smart phone interfacing through the wireless interface.

The electrical lift assist apparatus 100 may further include various members that form a frame or structure for attachment of the various elements. The electrical lift assist apparatus 100 may include or be installed on a power rack 140. The power rack 140 may include barbell rest supports 146 that support the barbell bar 162 during resting phases. The power rack 140 may also include lower supports 142 for supporting the barbell bar 162 if the user is too fatigued to complete the repetition. The power rack 140 may also include an upper cross member 144 that may provide structural rigidity to the power rack 140 and allow for attachment of the components of the electrical lift assist device 102. The electrical hoist 110 may be attached to the power rack cross member 144 through one or more hoist attachments 116. The sensor 130 may also be mounted to the power rack cross member 144. The electrical hoist control module 220 and the user interface 202 may also be mounted to the power rack 140 for ease of access. A bench 150 may also be provided within the power rack 140 for bench press exercises.

Figure 5:
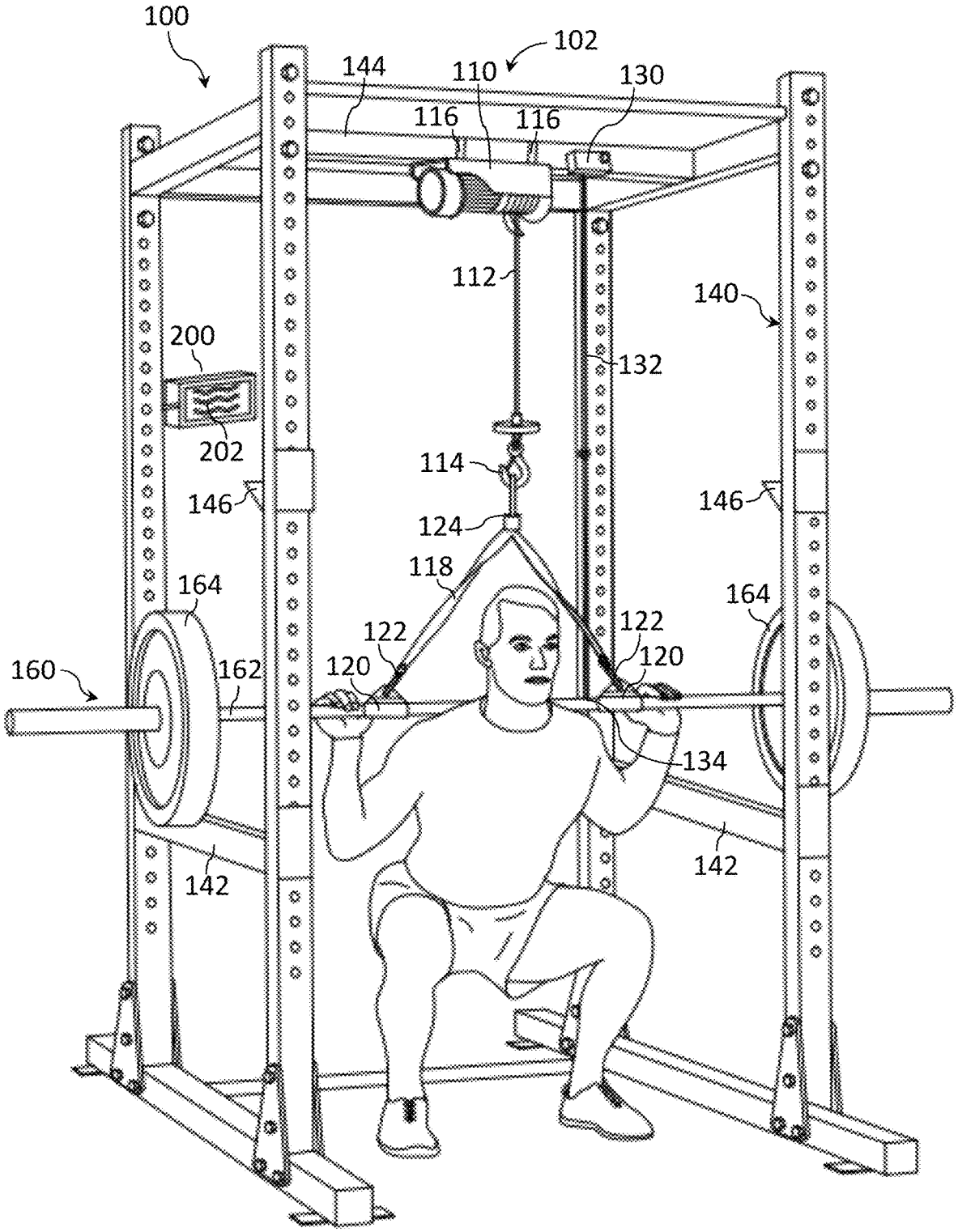
FIG. 5 is a front oblique view of a squat in a power rack with electrical lift assist device extended at bottom of repetition

FIG. 5 depicts another possible configuration of the electrical lift assist apparatus 100 in the form of a squat apparatus in a power rack 140 with a user. The squat apparatus in a power rack 140 may include an electrical hoist 110, sensor 130, barbell assembly 160, a controller 200 and a user interface 202. FIG. 5 depicts a view of the apparatus 100 at the bottom of the repetition with the electrical lift assist device 102 in a maximum extension or full load state.

It should be noted that a multiplicity of weight training machines are possible with the apparatus described, including but not limited to, a bench press, incline bench press, decline bench press, squat, military press, standing barbell curl and lying triceps extension, to name a few examples. There is applicability to both barbells and dumbbells.

Figure 6:
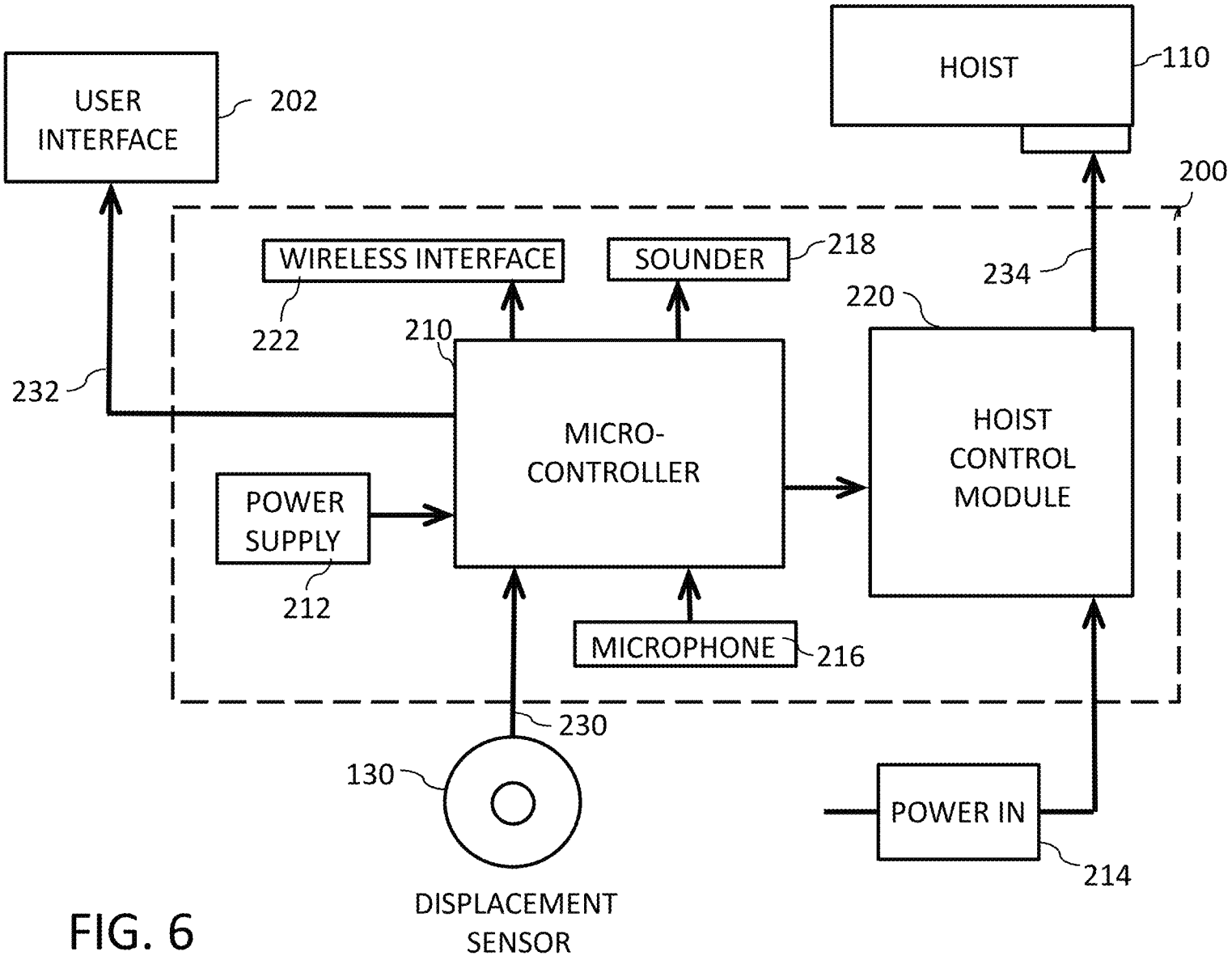
FIG. 6 is a diagram of an electronic control system.

FIG. 6 depicts an controller 200 and a user interface 202 that may be used to control and monitor the exercise apparatus. The controller 200 may include a microcontroller 210. The microcontroller 210 may be powered by a low voltage power supply 212 or battery.

The controller 200 may include an electrical hoist control module 220 that is configured to operate the electrical hoist 110. The electrical hoist control module 220 may include switching devices for selectively switching power and return signals to electrical hoist wires 234. For example, the switching devices may include relays and/or solid-state devices (e.g., bi-polar transistors, field-effect transistors, and/or complementary metal oxide semiconductors) to control voltage and current supplied to the electrical hoist 110. In some configurations, integrated circuits may be utilized that include solid-state switching devices. The electrical hoist control module 220 may receive power from an A/C power in source 214.

The controller 200 may include a wireless interface module 222 that is configured to provide wireless communication to external devices. The wireless interface module 222 may support wireless communication standards such as BLUETOOTH and/or wireless networking (Wi-Fi) as defined by Institute of Electrical and Electronics Engineers (IEEE) 802 family of standards (e.g., IEEE 802.11). The wireless interface module 222 may be configured to transfer data between the controller 200 and a remote device such as phone, tablet and/or computer. The microcontroller 210 may be programmed to implement a communications protocol that is compatible with the supported wireless communication standards.

The controller 200 may include a connection interface that allows electrical connection of the various components. In some configurations, the electrical connections may be hard-wired via connectors. For example, the longitudinal displacement sensor wires 230 may be routed to the connection interface for input into the microcontroller 210. In some configurations, longitudinal displacement sensor wires 230 may be routed directly to the microcontroller 210. All sensors described herein may be electrically coupled via the connection interface. The connection interface may also include interface circuitry to scale and/or isolate input and output signals.

The microcontroller 210 may provide output signals to control the switching devices of the electrical hoist control module 220. The microcontroller 210 may include one or more analog-to-digital (A/D) channels to convert the various input signals from analog to digital form. For example, A/D channels may be used for signals from the longitudinal displacement sensor 130, the voltage sensor, and the current sensor. The longitudinal displacement sensor 130 may be electrically coupled to the microcontroller 210 through a longitudinal displacement sensor wires 230. The microcontroller 210 may include a processor for executing instructions and volatile and non-volatile memory for storing data and programs. The microcontroller 210 may include various timer/counter inputs for processing data from other sensors.

The user interface 202 may be a dedicated user interface that is coupled to the exercise apparatus. The user interface 202 may include a display for outputting information to the user. The user interface 202 may include an input module. The input module may be configured to allow user input for configuring the exercise machine. For example, the user interface 202 may be a touch screen that allows display and input of information. In some configurations, physical buttons may be included that allow the user to select various features. The user interface 202 may be controlled and monitored by the microcontroller 210. In some configurations, the user interface 202 may include a dedicated microprocessor and communication with the microcontroller 210 via serial data link 232. The user interface 202 may be configured to allow the user to selectively actuate the electrical hoist 110 manually via menus or button presses. For example, pressing a retract button may cause the electrical hoist 110 to retract while the retract button is pressed.

In other configurations, the user interface 202 may be a remote device. Communication between the microcontroller 210 and the user interface 202 may be via the wireless interface module 222. For example, an application may be executed on a tablet or smart phone that allows display of information to the user and allows the user to configure the exercise machine.

The controller 200 may be utilized to monitor and control an exercise session. The controller 200 may be programmed to extend and retract the electrical hoist 110 by commanding the electrical hoist 110. During an exercise session, the user may struggle to raise the barbell assembly 160 due to muscle fatigue or weakness. The microcontroller 210 may be programmed to detect a stall condition in which the user can no longer lift the weight. A stall condition may be identified as a condition in which the lift displacement is increasing at a rate that is lower than a predetermined rate while the lift displacement is within a predetermined range. If a stall condition is detected, the microcontroller 210 may be programmed to assist the user by controlling the electrical hoist 110. For example, the electrical hoist 110 may be controlled to lift the hoist cable 112 and accordingly the hoist cable hook 114. The electrical hoist 110 may also be controlled to maintain the assistance of the barbell assembly 160 until the generally vertical lift displacement begins to increase again.

The microcontroller 210 may be programmed to actuate the electrical hoist 110 to achieve a selected assistance profile. Various open-loop and closed-loop strategies are available to achieve a selected assistance. Open-loop examples include monitoring the current and actuation time during operation of the electrical hoist 110.

Figure 7:
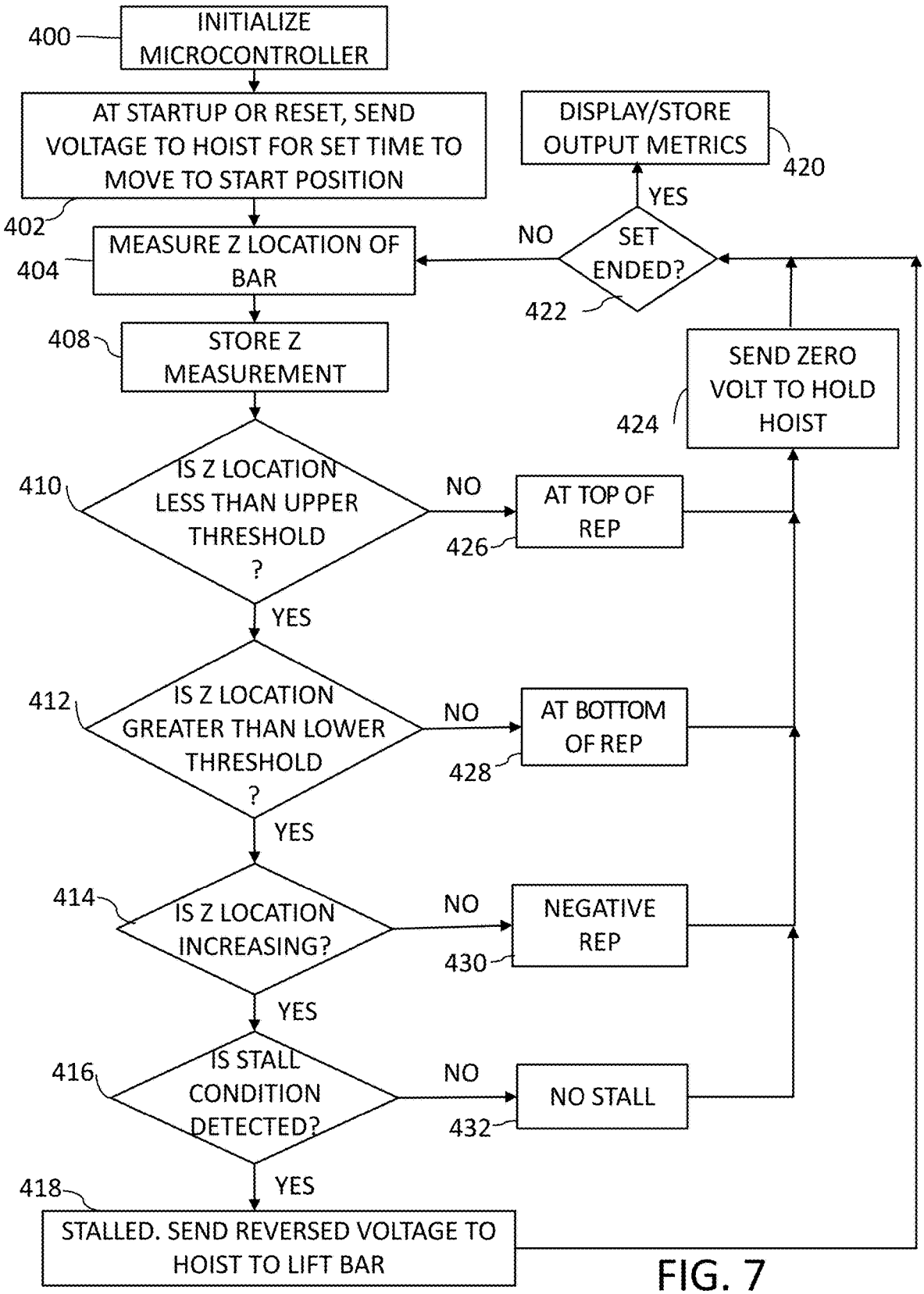
FIG. 7 is a possible logic flowchart depicting operations performed by the electronic control system for controlling operation of the mechanism.

FIG. 7 depicts a flowchart for a possible sequence of operations that may be implemented in the microcontroller 210 to detect and manage a stall condition. At operation 400, the microcontroller 210 may be initialized. Instructions may be executed to initialize variables for an exercise session. At operation 402, a voltage may be applied to the electrical hoist 110 for a predetermined time (e.g., 2 seconds) to cause the hoist cable 112 to move to its start position. In general, a voltage may be applied to place the hoist cable hook 114 in a predetermined position. The particular voltage pattern may depend on the present position of the cable hook 114 and the target position of the cable hook 114.

At operation 404, the generally vertical lift location of the barbell assembly 160 may be measured by sampling the signal from the longitudinal displacement sensor 130. The measured lift location may be a distance relative to the resting location. The resting location of the barbell assembly 160 may be known and stored in the microcontroller 210. At operation 408, the lift location measurement may be stored in controller memory. For example, a buffer of lift location measurements may be stored representing a predetermined number of location measurements over a predetermined time interval. That is, lift position values are available from previous repetitions. A bottom position and peak position may be determined by monitoring the lift positions during a repetition. For example, the top position may be maximum lift position measured during the repetition and the bottom-most position may be the minimum lift position measured during the repetition. A total lift travel range may be defined by the peak position and the bottom position. The peak position may be derived from the lift position signal measured during at least one previous repetition as the lift position value at which the lift position stops increasing. The bottom position may be derived from the lift position signal measured during at least one previous repetition as the lift position value at which the lift position stops decreasing.

A stall condition may occur when the lift velocity of the barbell assembly 160 approaches zero. To ensure proper detection of a stall situation, certain lift position values may be filtered out. For example, the lift velocity goes to zero at the top and bottom of an exercise cycle. At these points, the lift velocity is expected to change polarity and pass through zero. Realizing this, one can exclude these points by detecting a stall condition only within a predetermined range of lift positions.

At operation 410, the lift position measurement may be compared to an upper threshold value (e.g., 33 inches). The upper threshold value may correspond to a position indicative of approaching a top-most position of an exercise cycle at which lift velocity is expected to approach zero (e.g., lift position stops increasing). Operation 426 may be executed if the lift position measurement is greater than or equal to the upper threshold value. At operation 426, a flag may be set indicating the top of an exercise cycle. Operation 424 may then be executed to hold the electrical hoist 110 in the current position. For example, no voltage is applied to the electrical hoist 110. The upper threshold value may be a maximum lift position of the predetermined range of lift positions and may be a predetermined percentage less than the peak lift position of the total lift travel range.

Operation 412 may be executed if the lift position measurement is less than the upper threshold value. At operation 412, the measured position may be compared to a lower threshold value (e.g., 26 inches). The lower threshold value may correspond to a lift position indicative of approaching a bottom-most position of an exercise cycle at which lift velocity is expected to approach zero (e.g., lift position stops decreasing). Operation 428 may be executed if the measured lift position is less than or equal to the lower threshold value. At operation 428, a flag may be set indicating the bottom of an exercise cycle. Operation 424 may then be executed to hold the electrical hoist 110 in the current position. The lower threshold value may be a minimum lift position of the predetermined range of lift positions and may be a predetermined percentage greater than the lowest lift position of the total lift travel range.

Operation 414 may be executed if the lift position measurement is greater than the lower threshold value. At operation 414, a check is made to determine if the lift position is decreasing. A rate of change of the lift position (e.g., lift velocity) may be computed and compared to a predetermined threshold. For example, a lift velocity less than zero may be indicative of a decreasing lift position. In another example, a maximum position from the previous three measurements may be computed. A difference between the maximum position and the current position measurement may be computed and compared to a threshold (e.g., 1 inch). If the position is not increasing, then operation 430 may be executed. At operation 430, a flag may be set indicating a negative exercise cycle. That is, the barbell assembly 160 is moving toward the bottom position. Operation 424 may then be executed to hold the electrical hoist 110 in the current position.

If the lift position is increasing, then operation 416 may be performed. At operation 416 a stall condition is monitored. A rate of change of the measured lift position may be computed. If the rate of change is less than a predetermined rate, a stall condition may be detected. The rate of change may be monitored to determine if the polarity of the rate of change reverses. This may be indicative of a stall condition. For example, a difference between the present lift position measurement and the maximum lift position from the previous three lift position measurements may be computed and compared to a stall threshold (e.g., 0.5 inch). If a stall condition is not detected, then operation 432 may be performed. At operation 432, a flag may be set indicate a non-stall condition. Operation 424 may then be executed to hold the electrical hoist 110 in the current position.

If a stall condition is detected, then operation 418 may be performed. At operation 418 a flag may be set indicating the stall condition. The electrical hoist 110 may be operated to move the barbell assembly 160 upwards and assist the user. The effect is to reduce the load so that the exercise cycle may continue. For example, the microcontroller 210 may apply a voltage to the terminals of the electrical hoist 110. If the lift velocity begins to increase again, the voltage may be set to zero to hold the hoist cable position.

After operation 424 and operation 418, operation 422 may be performed. At operation 422, a check is performed to determine if the exercise session has ended. For example, a number of exercise cycles may be monitored and if the number is greater than a target number, the set may be complete. Alternatively, the lift position may indicate that the barbell assembly 160 is in the rest position for more than predetermined inactivity time. In some configurations, a user input received from the user interface 202 may indicate the end of the exercise session. If the set has not ended, the sequence may repeat starting at operation 404. The sequence starting at operation 404 may be repeated at periodic time intervals according to a selected sample rate. For example, the sequence of operations may be repeated every 0.25 seconds. If the exercise session is complete, operation 420 may be performed. At operation 420, exercise metrics may be computed. The exercise metrics may be stored in non-volatile memory for later retrieval. The exercise metrics may also be displayed on the display or remote device.

The microcontroller 210 may be programmed to calculate an average force, energy, and power lifted during the exercise session to provide a continuous performance metric. For example, the value of the weight plates 164 mounted to the barbell assembly 160 may be entered via the user interface 202. An average force may be computed during the exercise session and stored in non-volatile memory and output to the user interface 202. Knowing the force, an amount of energy expended may be computed, stored in non-volatile memory and output to the user interface 202. Also, knowing the time duration of the set, an amount of power expended may be computed, stored in nonvolatile memory and output to the user interface 202.

Additional metrics may also be computed. For example, the number of exercise cycles during the exercise session may be computed by counting the number of up/down cycles. In addition, an average force, energy or power per set may be computed for the exercise session. A total amount of weight lifted may be computed as a sum of the weights (or average weight) associated with each exercise cycle. An average lift speed over the exercise cycle may be computed. Various other performance metrics may be computed and output to the user interface 202.

The controller 200 may be programmed to estimate an average force over a number of repetitions. The number of repetitions may be a targeted number selected by the user depending upon specific fitness goals. The average force value may be stored in memory and displayed via the user interface 202. For example, computing an average force over six repetitions may be useful for monitoring strength increases. Computing an average force over ten repetitions may be useful for monitoring for muscle hypertrophy. Computing an average force over fourteen repetitions may be useful for monitoring endurance. In addition, an average energy for a set of repetitions may be computed. The metrics provide an improved indication of exercise progress.

The controller 200 may also be utilized to implement various weight assistance profiles during an exercise session. For example, the microcontroller 210 may be programmed to vary the assistance according to a user selected profile. A profile that varies the assistance during an exercise cycle may be implemented. For example, an assistance profile may start with a lower assistance floor at the start of the exercise cycle and increase as the repetitions increase. Numerous other profiles are possible.

Figure 8:
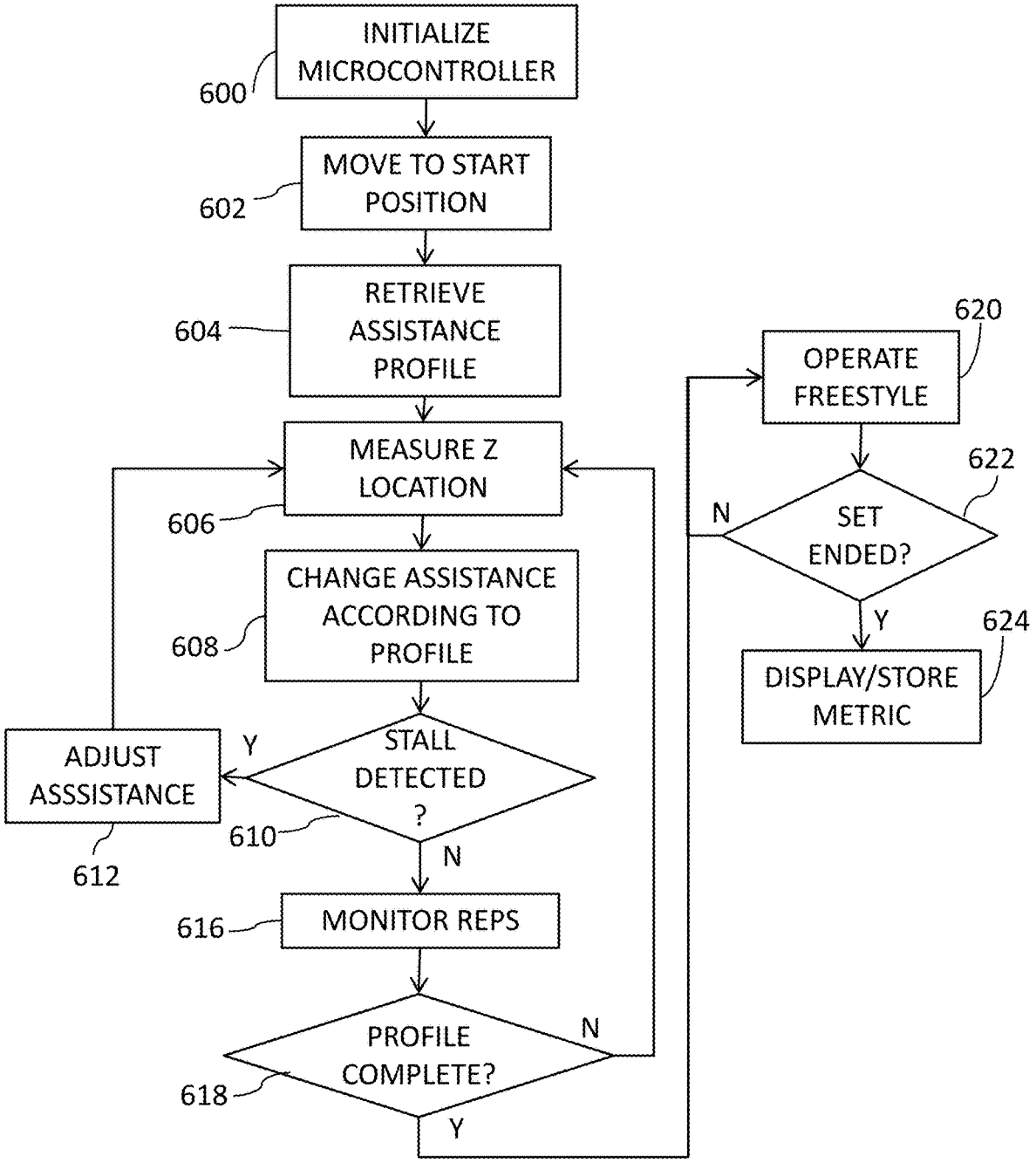
FIG. 8 is a possible logic flowchart depicting operations performed by the electronic control system for implementing an assistance profile.

FIG. 8 depicts a possible sequence of instructions that may be implemented by the microcontroller 210. At operation 600, the microcontroller may be initialized. At operation 602, a voltage may be applied to the electrical hoist 110 to position the hoist cable 112 to a starting position. For example, the hoist cable 112 may be positioned in a mid-range position that is allows full travel of the barbell assembly 160 without any force on the hoist cable 112. This would permit free repetitions until the hoist 110 is activated.

At operation 604, an assistance profile may be read from memory or entered by the user. The assistance profile may include a period of increasing assistance. The assistance profile may include a period of constant assistance. The assistance profile may include a period of adaptive assistance based on performance of the user. The assistance profile may be defined for a predetermined number of exercise cycles. In various examples, the assistance profile may be expressed as an assistance position profile based on time, repetition, and/or lift position.

At operation 606, the lift position of the barbell assembly 160 may be measured by sampling the signal from longitudinal position sensor 130. At operation 608, the assistance may be changed according to the selected profile. The present assistance displacement may be compared to the target assistance displacement and the electrical hoist 110 may be controlled to drive the assistance displacement to the target assistance displacement. For example, the microcontroller 210 may command a voltage signal to the electrical hoist 110 to extend or retract the hoist cable 112 based on the deviation between the desired assistance and the present assistance. The barbell assembly 160 may be lifted to a position that is derived from the assistance profile.

At operation 610, conditions for a stall condition may be checked. For example, stall detection operations from FIG. 7 may be performed to determine if the barbell assembly 160 has stalled during a lift operation. If a stall condition is detected, operation 612 is performed. At operation 612, the assistance is adjusted to compensate for the stall condition. The target assistance displacement may be increased in response to a stall condition. For example, the hoist 110 may be controlled to cause the hoist cable 112 to reduce the generally vertical distance between the hoist 110 and the barbell assembly 160 to a predetermined amount to increase the assistance. The hoist cable 112 may remain in the reduced generally vertical position until motion of the barbell assembly 160 resumes (e.g., the lift position begins increasing again).

If no stall condition is present, then operation 616 may be performed. Operation 616 may monitor the number of exercise cycles and store the number in memory for later use. At operation 618, a check may be performed to determine if the profile has been completed. If the profile is not completed, the sequence of operations starting with operation 606 may be repeated. If the profile is completed, operation 620 may be executed. At operation 620, the machine may be operated in a freestyle mode, for example. At operation 622, a check is made to determine is the exercise session is ended. For example, the measured lift position may be checked to determine if the barbell assembly 160 is in the resting position for more than a predetermined time. If the set has not ended, operation 620 may be repeated. If the set has ended, operation 624 may be executed to compute, display and/or store the various metrics from the exercise session.

Figure 9:
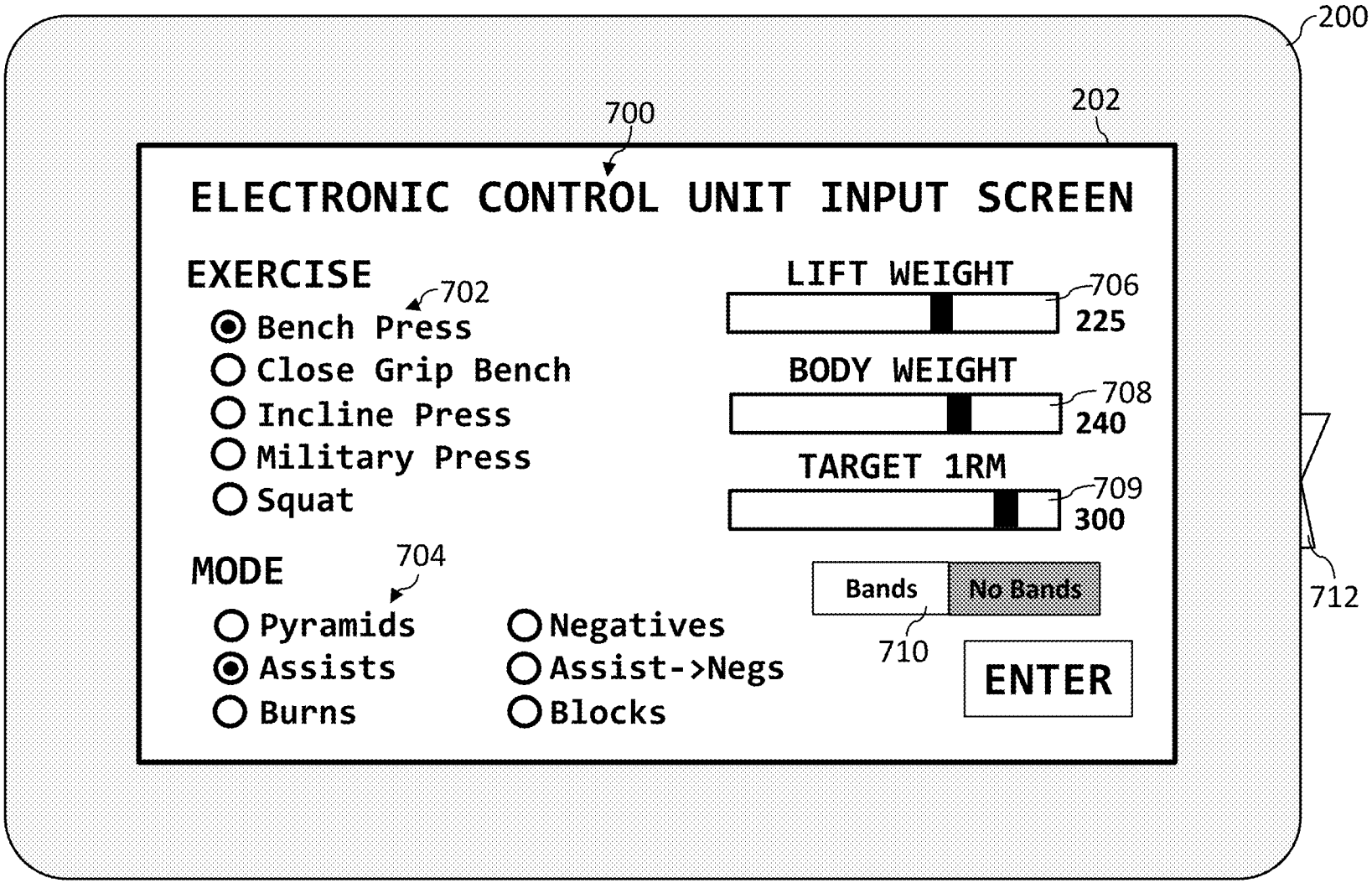
FIG. 9 is a possible user interface configuration for data input.

FIG. 9 depicts a possible configuration for a user interface 202. For example, the user interface 202 may be, but not limited to, a thin-film-transistor liquid-crystal display (TFT LCD) or a smart phone. The user interface 202 may include a touch screen display for user input. The outputs of the user interface 202 may be coupled to the microcontroller 210. The user interface 202 may include a power button 712 or switch. The power button 712 may be configured to turn the apparatus on and off.

The user interface 202 may include a user input screen 700. The user input screen 700 may include an exercise selector 702 may be configured to have a plurality of discrete selections. Each of the selections may be used to indicate a particular exercise profile. For example, the exercise selector 702 may have five distinct selections. For example, the exercise selection may be described as, but not limited to, "Bench Press", "Close Grip Bench", "Incline Press", "Military Press", and "Squat".

The user input screen 700 may also include a mode selector 704. The microcontroller 210 may monitor the mode selector 704 and operate the exercise apparatus in the selected mode of operation. Each of the mode selections may be used to indicate a particular mode of exercise. For example, the mode selector 704 may have six distinct selections. For example, the mode selection may be described as, but not limited to, "Pyramids", "Assists", "Burns", "Negative", "Assist→Negative", and "Blocks".

The user input screen 700 may also include an input slider 706 for inputting the lift weight. The result of this slider 706 may be displayed next to the slider. The user input screen 700 may also include a body weight slider 708, for inputting the body weight of the user. The result of this slider 708 may be displayed next to the slider. The user input screen 700 may also include a slider 709, for inputting a target 1 rep maximum. The result of this slider 709 may be displayed next to the slider. During the set, the user may be alerted, for example, by a chime when they have performed enough repetitions to reach their targeted 1 rep maximum. The user input screen 700 may also include a toggle selector 710 for the use of elastic bands. The band selector 710 may have two options: "Bands" and "No Bands". Depending on the output of the band selector 710, the pre-position of the hoist cable 112 may be varied to appropriately stress the elastic members 170.

Figure 10:
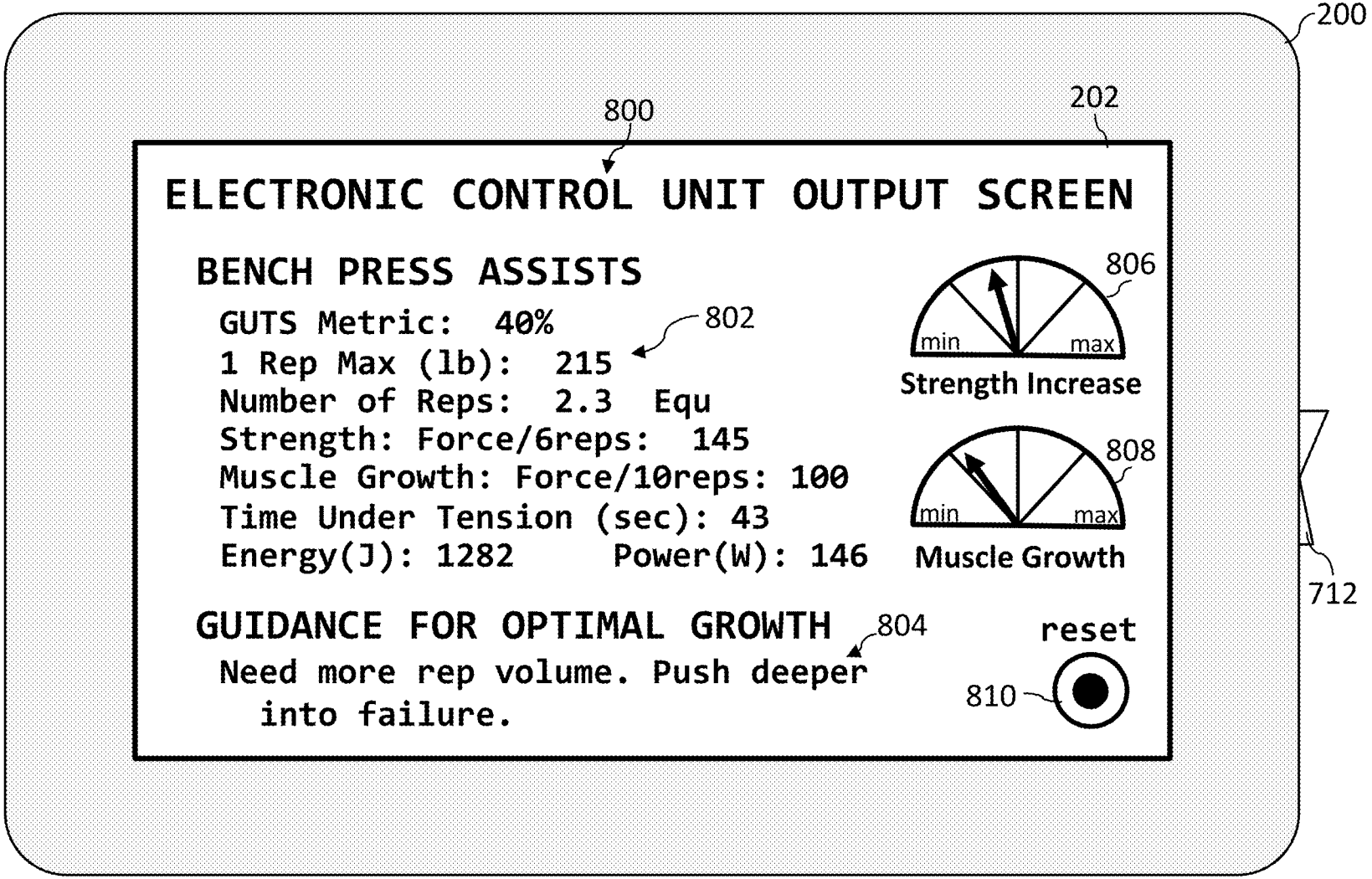
FIG. 10 is a possible user interface configuration for data output.

FIG. 10 depicts a possible configuration for a user interface 202. The user interface 202 may include an output display screen 800. The output display screen 800 may include a field for displaying multiple output metrics 802. For example, the output metrics may be described as, but not limited to, "GUTS Metrics", "1 Rep Maximum (1RM)", "Number of Reps", "Strength: Force/6Reps", "Muscle Growth: Force/10Reps", "Energy", "Time Under Tension", and "Power". The "GUTS" metric may be a numerical percentage metric indicating the amount of effort given by the user with respect to their ability. The 1 Rep Maximum (1RM) Is calculated empirically from the number of repetitions and the lift weight. This is an estimate of amount of weight the user could lift for one maximum weight repetition.

The output display screen 800 may also include a field 804 for displaying coaching guidance. The coaching guidance field 804 may provide specific direction to the user based on the performance metrics measured. The output display screen 800 may also include a dial indicator for strength increase 806 and a dial indicator for muscle growth 808. Both dials may rate the potential for growth based on lift metrics and display on a min to max dial. The output display screen 800 may also include a reset button 810 for resetting the controller 200 to its default starting state.

The exercise apparatus may operate according to a selected exercise profile as selected by the user input screen 700. The exercise mode and profiles may be managed and controlled by the microcontroller 210. The microcontroller 210 may be programmed to implement instructions for implementing each of the exercise mode and profiles to be described.

Figure 11:
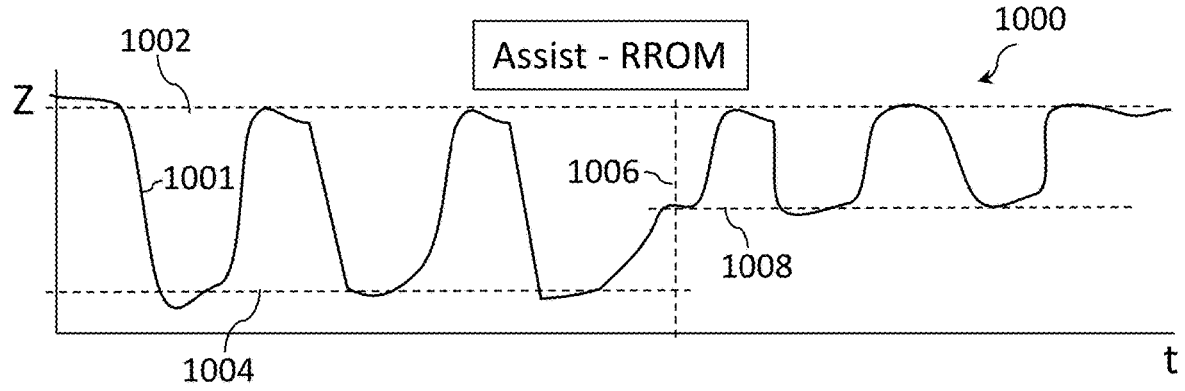
FIG. 11 is a displacement versus time profile for an assisted repetition profile selection ending with a reduced range of motion.

FIG. 11 depicts a graph of displacement versus time for an assisted repetition exercise profile 1000. The assisted repetition mode may define a starting lower assistance level 1004. The controller 200 may monitor the operator performance during the exercise cycle. In the event a stall condition is detected, the controller 200 may raise the assistance level to allow more repetitions to be completed. During an exercise cycle, each time a stall event is detected, the assistance may be increased. For example, when a stall event is detected, the hoist 110 may be commanded to retract to raise the lower assistance level. For example, the controller 200 initially commands the exercise apparatus to provide the starting lower assistance level 1004. In this example, the upper level 1002 is defined for the selected exercise. The barbell movement 1001 may be measured by the sensor 130. A first user stall event 1006 may be detected. After the first user stall event 1006, the exercise apparatus is commanded to a second assistance level 1008, which reduces the range of motion of the exercise. With the reduced range of motion, the user can continue with the exercise.

Figure 12:
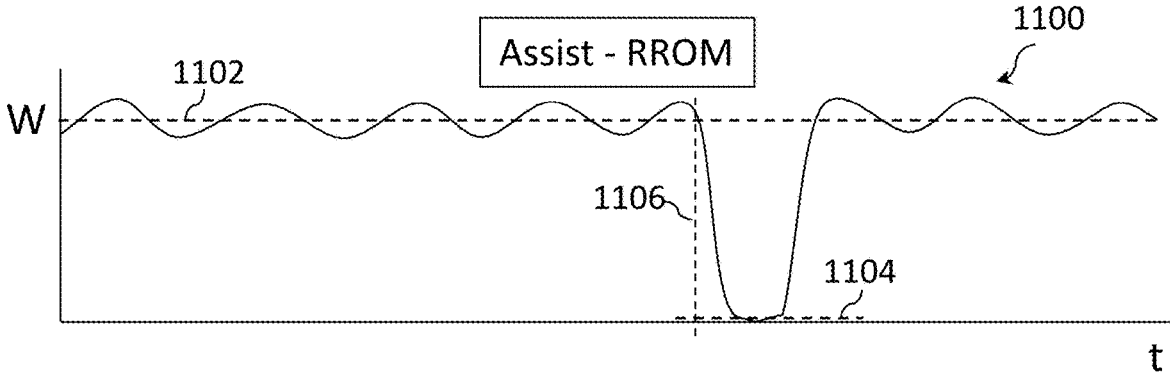
FIG. 12 is a force versus time profile for an assisted repetition profile selection.

FIG. 12 depicts a graph of force versus time for an assisted repetition exercise profile 1100. This profile represents the weight the user would experience during the previously describe assistance profile 1000, in FIG. 11. The exercise cycle may begin with a specified weight level 1102 on the barbell assembly 160. During the exercise cycle, the controller 200 may monitor the operator performance. For example, when a stall event is detected, the hoist 110 may be commanded to retract to raise the lower assistance level. A first user stall event 1106 may be detected. After the first user stall event 1106, the exercise apparatus may be commanded to assist the user for a period of time sufficient raise the barbell assembly 160 beyond the 'sticking point'. During this assistance, the weight loading experienced by the user would drop to a lower level 1104, as the hoist 110 does the work. After assistance, the apparatus may reduce the range of motion, but the load experienced by the user would return to level 1102.

Figure 13:
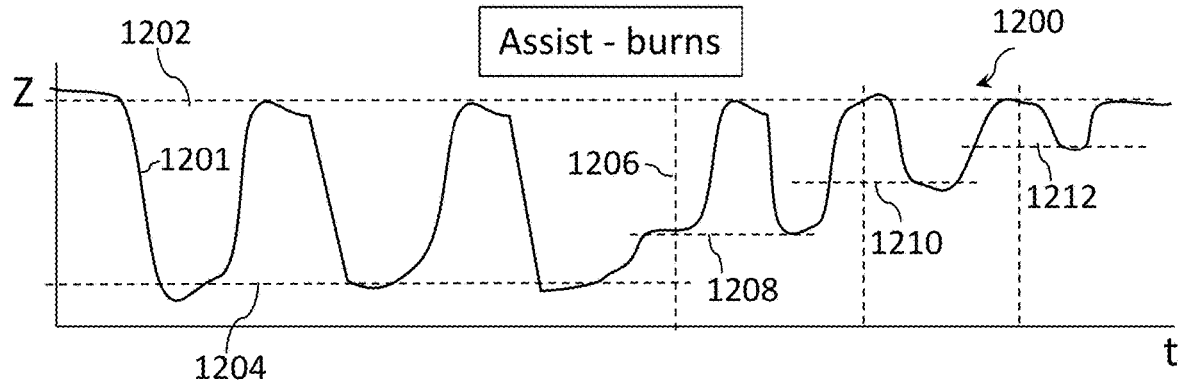
FIG. 13 is a displacement versus time profile for an assisted repetition profile selection ending with a multiplicity of reduced ranges of motion.

FIG. 13 depicts a graph of displacement versus time for an assisted repetition exercise profile 1200. The assisted repetition mode may define a starting lower assistance level. The controller 200 may monitor the operator performance during the exercise cycle. In the event a stall condition is detected, the controller 200 may raise the assistance level to allow more repetitions to be completed. During an exercise cycle, after the first stall event is detected, the assistance may be continually increased by the controller 200. For example, when a stall event is detected, the hoist 110 may be commanded to retract to raise the lower assistance level. For example, the controller 200 initially commands the exercise apparatus to provide the starting lower assistance level 1204. In this example, the upper level 1202 is defined for the selected exercise. The barbell movement 1201 may be measured by the sensor 130. A first user stall event 1206 may be detected. After the first user stall event 1206, the exercise apparatus is commanded to a second assistance level which results in a second lower assistance level 1208. After a specified time duration, number of repetitions, or subsequent stall event, the controller 200 may automatically raise the hoist cable hook 114 to a new second lower level 1210. Again, after a specified time duration, number of repetitions, or subsequent stall event, the controller 200 may automatically raise the hoist cable hook 114 to a third new lower level 1212. With the increasing reduced range of motion, the user is enabled to continue with the exercise. This sequence of reducing the range of motion may continue for any number of cycles. This results in final "burn" repetitions.

Figure 14:
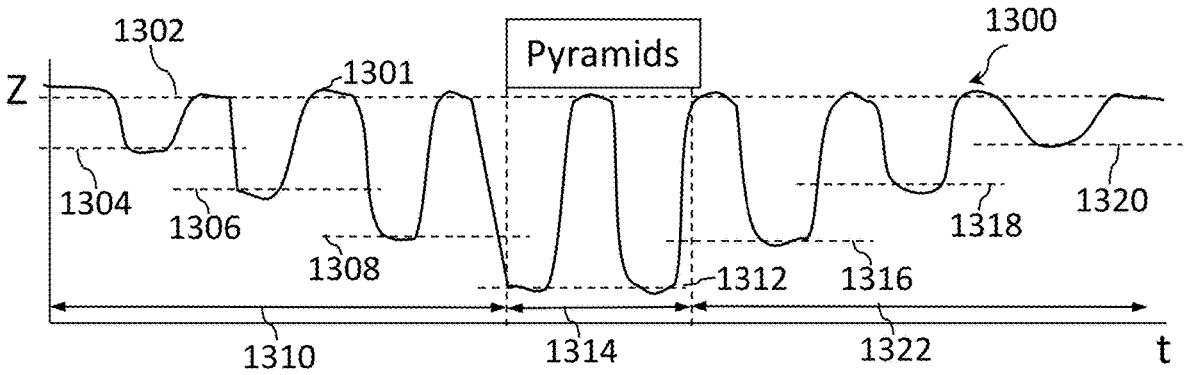
FIG. 14 is a displacement versus time profile for a pyramid profile selection.

FIG. 14 depicts a graph of displacement versus time for a pyramids exercise profile 1300 with a predefined upper level 1302. The pyramids profile may be characterized by an increase in range of motion over a number of repetitions followed by a decrease in range of motion as the end of the exercise cycle approaches. The controller 200 may command an increasing range of motion during an increase segment 1310 of the exercise cycle. The controller 200 may monitor the displacement of the barbell assembly 160 to determine when a repetition is completed. The barbell movement 1301 may be measured by the sensor 130. For each repetition during the increase segment 1310, the range of motion may be increased by a predetermined amount. During the increase segment 1310, the lower support level may move from level 1304 to a second level 1306 to a third level 1308 and to a fourth level represented as peak segment 1314. A multiplicity of levels is possible. The predetermined amount may be selectable by the operator. After a predetermined number of repetitions, the controller 200 may command a constant peak range of motion during a peak segment 1314. In some cases, the peak segment 1314 may be one repetition. After completion of the peak segment 1314, the controller 200 may command a decreasing assistance profile during a decrease segment 1322. During the decrease segment 1322, the controller 200 may command a decrease in range of motion after each repetition. During decrease segment 1322, the lower support level may move from level 1312 to a second level 1316 to a third level 1318 and to a fourth level 1320. A multiplicity of levels is possible. The general profile may resemble a pyramid. The controller 200 commands the hoist 110 to retract and extend to achieve the desired range of motion during the profile. In some configurations, the controller 200 may be programmed to execute this profile based solely on the time from the start of the lift.

Figure 15:
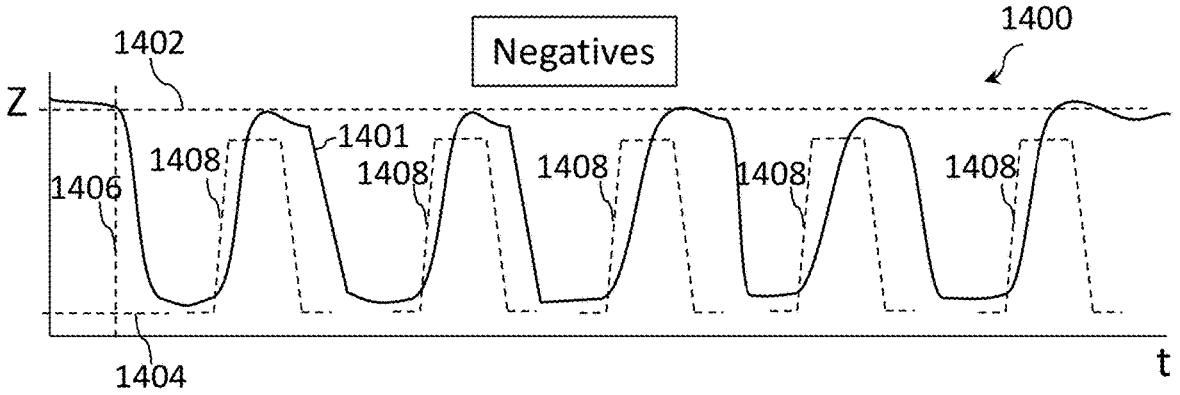
FIG. 15 is a displacement versus time profile for a negative profile selection.

FIG. 15 depicts a graph of displacement versus time for a negative exercise profile 1400. The negative exercise profile may be characterized by assistance during the upward motion of the barbell assembly 160 and little or no assistance (i.e., moving the hoist cable hook 114 downward so that the cable is not tensioned during the lift thus disengaging the hoist) during the downward motion of the barbell assembly 160. The barbell movement 1401 may be measured by the sensor 130. The negative set may be initiated when initial movement of the barbell assembly is detected 1406. The controller 200 may store an upper level 1402 and a lower level 1404 for the range of motion of the exercise. After initiation 1406, the barbell assembly 160 may be lowered freely. At the bottom of the repetition, which may occur at lower level 1404, the controller 200 may send a signal to the hoist 110 to raise the barbell assembly 160 to the top of the repetition, assure the user has control and then lower the support, leaving the barbell assembly 160 at the top of the repetition. This assist-release profile represents the negative assist cycle 1408. The user may then slowly lower the barbell assembly 160 to perform a negative repetition. The negative assist cycle 1408 may be repeated multiple times, as long as the user is actively lowering the barbell assembly 160. The negative lift profile 1400 may cease when the user returns the barbell assembly 160 to its rest supports or the user is unable to support the barbell assembly 160 at the top of the repetition. The negative profile may be configured to provide more resistance during the descent phase than during the lift phase.

Figure 16:
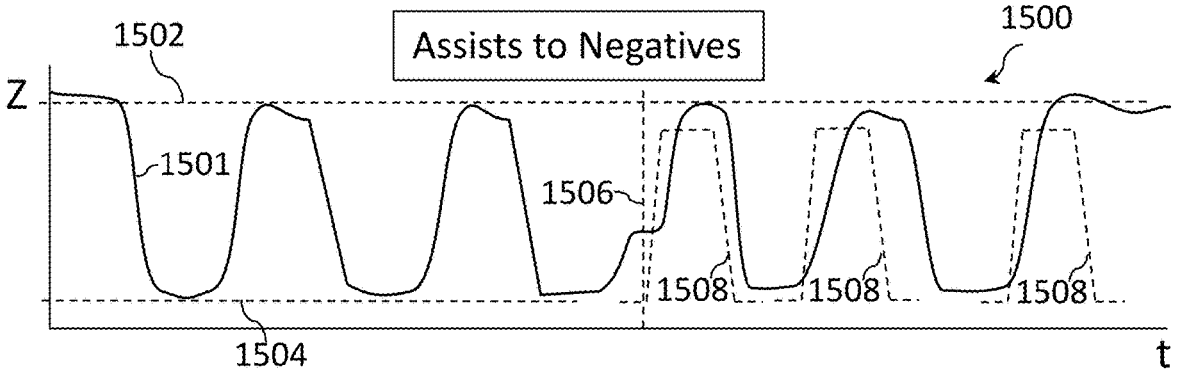
FIG. 16 is a displacement versus time profile for an assisted repetition profile selection ending with negatives.

FIG. 16 depicts a graph of displacement versus time for an assist-to-negative exercise profile 1500. The assist-to-negative exercise may be a combination of the assisted repetition profile 1000 in FIG. 11 and the negative exercise profile 1400 in FIG. 15. The exercise may begin as an assisted repetition exercise with upper level 1502 and lower level 1504 defined. The barbell movement 1501 may be measured by the sensor 130. At 1506, the controller 200 may detect a stall condition. Upon detection of a stall, the controller 200 may begin the negative assist cycle 1508, as described for FIG. 15. After the user stall 1506, the set may be continued as a negative set, allowing the user to exercise deeper into muscular failure.

Figure 17:
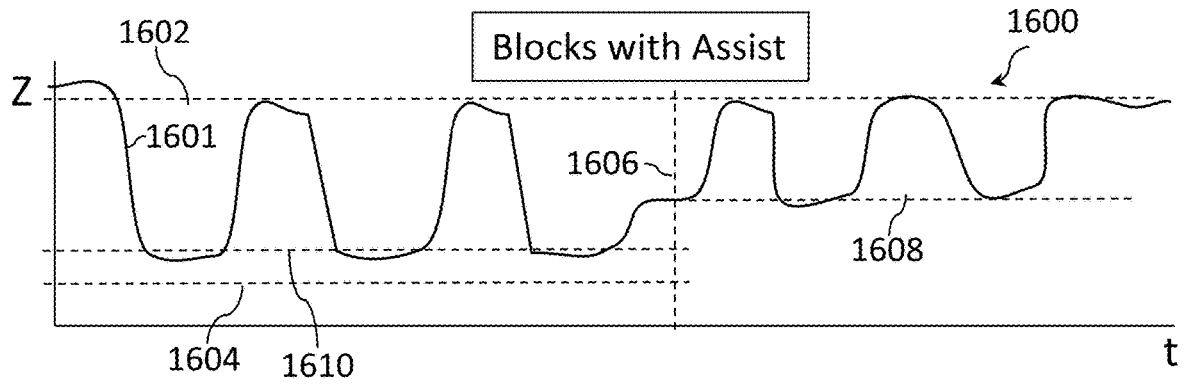
FIG. 17 is a displacement versus time profile for an assisted repetition profile selection starting with and ending with a reduced range of motion.

FIG. 17 depicts a graph of displacement versus time for an assisted repetition exercise with blocks profile 1600. This exercise profile may represent an exercise where blocks are placed on the user to reduce the range of motion, a practice used in powerlifting. The assisted repetition mode may define a starting lower assistance level. The controller 200 may monitor the operator performance during the exercise cycle. In the event a stall condition is detected, the controller 200 may raise the assistance level to allow more repetitions to be completed. During an exercise cycle, each time a stall event is detected, the assistance may be increased. For example, when a stall event is detected, the hoist 110 may be commanded to retract to raise the lower assistance level. For example, the controller 200 initially commands the exercise apparatus to provide the lower assistance level 1610, which may be different from the previous starting lower assistance level 1604. In this example, the upper level 1602 is defined for the selected exercise. The barbell movement 1601 may be measured by the sensor 130. A first user stall event 1606 may be detected. After the first user stall event 1606, the exercise apparatus is commanded to a second assistance level which results in a second lower assistance level 1608. With the reduced range of motion, the user is enabled to continue with the exercise.

Figure 18:
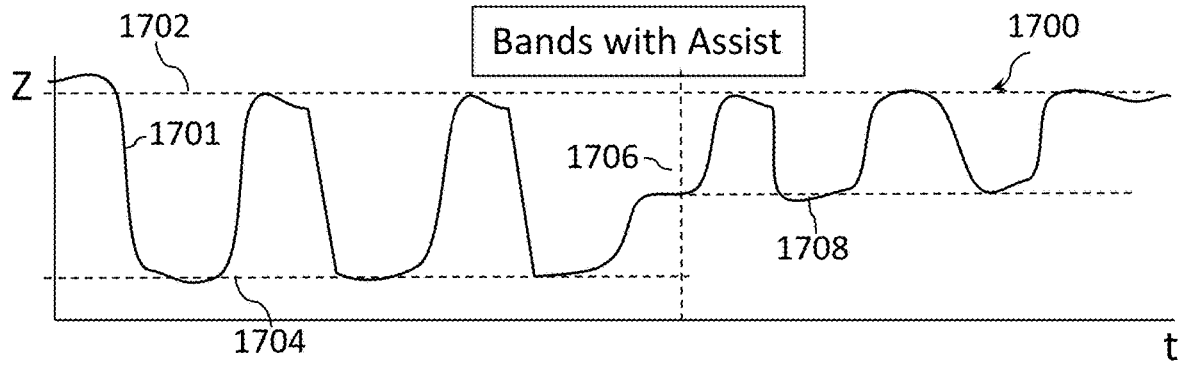
FIG. 18 is a displacement versus time profile for an assisted repetition profile selection ending with a reduced range of motion and elastic bands.

FIG. 18 depicts a graph of displacement versus time for an assisted repetition exercise profile with bands 1700. This exercise mode is very similar to the assisted repetition mode shown in FIG. 11. In this mode, one or more elastic members 170 may be added between the hoist cable hook 114 and the barbell assembly 160. For example, this elastic member may be a band that allows the user to bear more of the assistance force. The assisted repetition mode may define a starting lower assistance level 1704. The controller 200 may monitor the operator performance during the exercise cycle. In the event a stall condition is detected, the controller 200 may raise the assistance level to allow more repetitions to be completed. During an exercise cycle, each time a stall event is detected, the assistance may be increased. For example, when a stall event is detected, the hoist 110 may be commanded to retract to raise the lower assistance level. For example, the controller 200 initially commands the exercise apparatus to provide the starting lower assistance level 1004. In this example, the upper level 1702 is defined for the selected exercise. The movement 1701 of the elastic members 170 may be measured by the sensor 130. A first user stall event 1706 may be detected. After the first user stall event 1706, the exercise apparatus is commanded to a second assistance level 1708 which reduces the range of motion of the exercise. With the reduced range of motion, the user is able to continue with the exercise.

Figure 19:
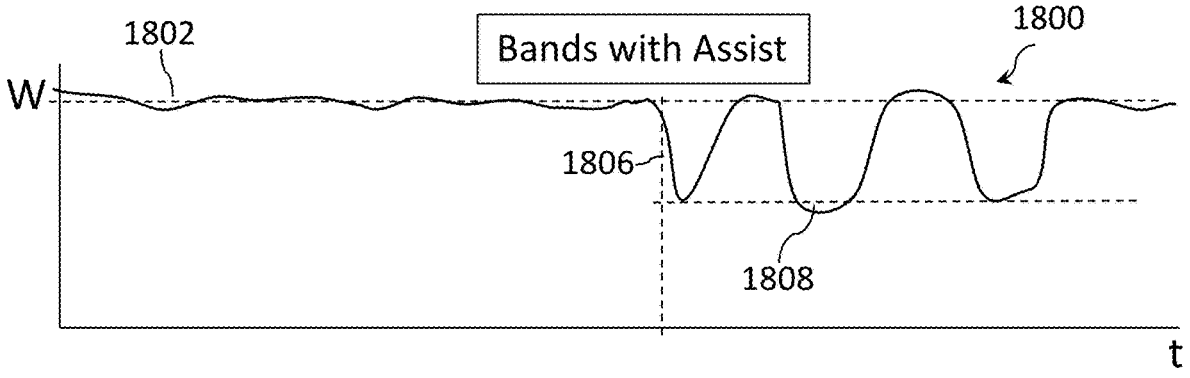
FIG. 19 is a force versus time profile for an assisted repetition profile selection ending with a reduced range of motion and elastic bands.

FIG. 19 depicts a graph of force versus time for an assisted repetition exercise profile with bands 1800. This exercise mode is very similar to the assisted repetition mode shown in FIG. 11. Depending on the length of the elastic member 170 and the presence or absence of the semi-rigid straps 118, the user may bear more of the assistance force. The weight on the barbell assembly 160 may be the initial force represented by upper level 1802 that the user will resist. For this example, when the controller 200 detects a stall event 1806, the hoist 110 may be activated to raise the hoist cable hook 114. The upward movement of the hoist cable hook 114 may tension the elastic member 170. After the stall event 1806, the force the user resists may be a combination of the barbell assembly weight minus the upper force in the elastic member 170. The user force level after the stall event 1806 may vary between a lower level 1808 and an upper level 1802. This will effectively reduce the force experience by the user after the stall event 1806.

Various conditions may be monitored to detect when the user is in need of assistance. The controller 200 may be programmed to evaluate a descent speed condition that compares the descent speed to a predetermined threshold. The descent speed being greater than the predetermined threshold may be indicative that the user is having difficulty exercising at the present resistance, thus needing assistance. The descent speed being less than or equal to the predetermined threshold may be indicative that the user can continue at the present resistance.

The controller 200 may be programmed to evaluate a lift speed condition. The lift speed being approximately zero may be indicative that the user is having difficulty exercising at the present resistance. This may be similar to a stall condition. The lift speed condition may be further conditioned on the generally vertical position to ensure that the low lift speed is not at the peak position or rest position of the repetition.

The controller 200 may be programmed to evaluate a range of motion condition. The controller 200 may monitor the lift location and determine a range of motion defined by a maximum lift position and a minimum lift position achieved during each repetition. The range of motion may be expressed as a difference between the maximum distance and the minimum distance. A baseline range of motion may be determined and stored during the weight selection mode of operation. The range of motion being less than a predetermined range may be indicative that the user is having difficulty exercising at the present resistance, thus needing assistance.

The controller 200 may be programmed to evaluate an electromyography (EMG) condition. The EMG sensor value being greater than a predetermined value may be indicative of the user being unable to lift the present resistance. The controller 200 may be programmed to evaluate a heart rate sensor condition. The heart rate sensor being greater than a predetermined value may be that the user is having difficulty exercising at the present resistance, thus needing assistance.

In some configurations, a heart rate sensor may be incorporated into the exercise. The heart rate sensor may be configured to provide a signal to the controller 200 indicative of the heart rate of the operator. The controller 200 may include an interface (e.g., hardware and software) to receive the signal from the heart rate sensor. The controller 200 may be programmed to evaluate a heart rate signal condition that compares the heart rate signal to a predetermined threshold. The heart rate being less than a predetermined rate during a repetition may be indicative that the user can handle additional resistance. The heart rate signal being greater than or equal to the predetermined rate may be indicative that the weight limit for the user has been reached and assistance is needed.

When a condition arises that is indicative of the user being unable to lift the present resistance, the controller 200 may be programmed to provide assistance by a predetermined amount. In addition, an indication may be provided that the condition is present. For example, the controller 200 may be programmed to generate an audible sound such as a chime through the audio output device 218. In addition, the controller 200 may display a message to the user, training partner or coach via the user interface 202.

The electrical lift assist device described provide several benefits to users. The direct connection to the weight provides a better feel to users. The ability to dynamically vary the assistance provides additional exercise options to maintain user interest and encourage exercise. In addition, the ability to detect a stall during lifting and provide assistance permits additional repetitions and may help to prevent injury. The ability to provide continuous value performance metrics and coaching advice also helps users to better progress over time. The modes of operation described allow the user to continue exercising beyond initial exhaustion for maximum growth.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

A first aspect of the present disclosure is directed to a weight training apparatus including an electrical hoist, a cable coupled to the electrical hoist, wherein a first end of the cable is coupled to the electrical hoist and a second end is configured to attach to a barbell assembly, a sensor configured to output a signal indicative of a lift position of the barbell assembly, and a controller programmed to compare the lift position to predetermined vertical locations and activate the electrical hoist to change the lift position of the barbell assembly based at least in part on at least one of the lift position or a vertical lift velocity relative to the predetermined vertical locations.

A second aspect of the present disclosure is directed to the weight training apparatus of the first aspect, wherein the controller is programmed to determine that the barbell assembly is at a top of a repetition if the lift position is greater than an upper threshold.

A third aspect of the present disclosure is directed to the weight training apparatus of the second aspect, wherein the controller is programmed to determine that the barbell assembly is at a bottom of a repetition if the lift position is less than a lower threshold.

A fourth aspect of the present disclosure is directed to the weight training apparatus of the third aspect, wherein the controller is programmed to activate the electrical hoist as a result of determining that the lift position of the barbell assembly is between the upper threshold and the lower threshold and as a result of detecting a stall condition.

A fifth aspect of the present disclosure is directed to the weight training apparatus of the first aspect, wherein the controller is programmed to determine that the lift position is increasing over a first period of time.

A sixth aspect of the present disclosure is directed to the weight training apparatus of the fifth aspect, wherein the controller is programmed to determine that the lift position is decreasing over a second period of time different from the first period of time.

A seventh aspect of the present disclosure is directed to the weight training apparatus of the first aspect, wherein the controller is programmed to execute a negative repetition as a result of predicting a decrease in the lift position and detecting that a user is at least partially supporting a weight of the barbell assembly.

An eighth aspect of the present disclosure is directed to the weight training apparatus of the seventh aspect, wherein the controller is programmed to disengage the electrical hoist as a result of identifying the negative repetition.

A ninth aspect of the present disclosure is directed to a controller for a weightlifting assist system, the controller comprising a memory, and a processor programmed to execute instructions stored in the memory, the instructions including receiving, from a sensor, a signal indicating a lift position of a barbell assembly, comparing the lift position to predetermined vertical locations, determining the lift position is between the predetermined vertical locations, detecting a stall condition, and activating an electrical hoist to change the lift position of the barbell assembly as a result of determining that the lift position is between the predetermined vertical locations and as a result of detecting the stall condition.

A tenth aspect of the present disclosure is directed to the controller of the ninth aspect, wherein the instructions include determining that the barbell assembly is at a top of a repetition if the lift position is greater than an upper threshold.

An eleventh aspect of the present disclosure is directed to the controller of the ninth aspect, wherein the instructions include determining that the barbell assembly is at a bottom of a repetition if the lift position is less than a lower threshold.

A twelfth aspect of the present disclosure is directed to the controller of the ninth aspect, wherein the instructions include determining that the lift position is increasing over a first period of time.

A thirteenth aspect of the present disclosure is directed to the controller of the twelfth aspect, wherein the instructions include determining that the lift position is decreasing over a second period of time different from the first period of time.

A fourteenth aspect of the present disclosure is directed to the controller of the ninth aspect, wherein the instructions include executing a negative repetition as a result of predicting a decrease in the lift position and detecting that a user is at least partially supporting a weight of the barbell assembly.

A fifteenth aspect of the present disclosure is directed to the controller of the fourteenth aspect, wherein the instructions include disengaging the electrical hoist as a result of identifying the negative repetition.

A sixteenth aspect of the present disclosure is directed to the controller of the ninth aspect, wherein the instructions include outputting coaching guidance to a display screen, wherein the coaching guidance is based at least in part on performance metrics.

A seventeenth aspect of the present disclosure is directed to the controller of the ninth aspect, wherein activating the electrical hoist includes activating the electrical hoist to execute an assist to negative cycle.

An eighteenth aspect of the present disclosure is directed to the controller of the ninth aspect, wherein the instructions include estimating a 1-Rep Maximum value and outputting the estimated 1-Rep Maximum value to a display screen.

A nineteenth aspect of the present disclosure is directed to a weight training apparatus including an electrical hoist, a cable coupled to the electrical hoist, wherein a first end of the cable is coupled to the electrical hoist and a second end is configured to attach to a barbell assembly via a tension-only member, a sensor configured to output a signal indicative of a lift position of the barbell assembly, and a controller programmed to compare the lift position to predetermined vertical locations and activate the electrical hoist to change the lift position of the barbell assembly based at least in part on at least one of the lift position or a vertical lift velocity relative to the predetermined vertical locations.

A twentieth aspect of the present disclosure is directed to the weight training apparatus of the nineteenth aspect, wherein the tension-only member includes at least one of a semi-rigid strap and an elastic member.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

The invention claimed is:

1. A weight training apparatus comprising:

an electrical hoist;

a cable coupled to the electrical hoist, wherein a first end of the cable is coupled to the electrical hoist and a second end is configured to attach to a barbell assembly;

a sensor configured to output a signal indicative of a lift position of the barbell assembly; and a controller programmed to compare the lift position to predetermined vertical locations and activate the electrical hoist to change the lift position of the barbell assembly based at least in part on at least one of the lift position or a vertical lift velocity relative to the predetermined vertical locations, wherein the controller is programmed to detect a stall condition, the stall condition being a condition in which the lift displacement is increasing at a rate that is lower than a predetermined rate while the lift displacement is within a predetermined range; the controller is programmed to activate the electrical hoist to change the lift position of the barbell assembly as a result of determining that the lift position is between the predetermined vertical locations and as a result of detecting the stall condition.

2. The weight training apparatus of claim 1, wherein the controller is programmed to determine that the barbell assembly is at a top of a repetition if the lift position is greater than an upper threshold.

3. The weight training apparatus of claim 2, wherein the controller is programmed to determine that the barbell assembly is at a bottom of a repetition if the lift position is less than a lower threshold.

4. The weight training apparatus of claim 3, wherein the controller is programmed to activate the electrical hoist as a result of determining that the lift position of the barbell assembly is between the upper threshold and the lower threshold and as a result of detecting the stall condition.

5. The weight training apparatus of claim 1, wherein the controller is programmed to determine that the lift position is increasing over a first period of time.

6. The weight training apparatus of claim 5, wherein the controller is programmed to determine that the lift position is decreasing over a second period of time different from the first period of time.

7. The weight training apparatus of claim 1, wherein the controller is programmed to execute a negative repetition as a result of predicting a decrease in the lift position and detecting that a user is at least partially supporting a weight of the barbell assembly.

8. The weight training apparatus of claim 7, wherein the controller is programmed to disengage the electrical hoist as a result of identifying the negative repetition.

9. A controller for a weightlifting assist system, the controller comprising:

a memory; and a processor programmed to execute instructions stored in the memory, the instructions including:

receiving, from a sensor, a signal indicating a lift position of a barbell assembly;

comparing the lift position to predetermined vertical locations;

determining the lift position is between the predetermined vertical locations;

detecting a stall condition, the stall condition being a condition in which the lift displacement is increasing at a rate that is lower than a predetermined rate while the lift displacement is within a predetermined range; and activating an electrical hoist to change the lift position of the barbell assembly as a result of determining that the lift position is between the predetermined vertical locations and as a result of detecting the stall condition.

10. The controller of claim 9, wherein the instructions include determining that the barbell assembly is at a top of a repetition if the lift position is greater than an upper threshold.

11. The controller of claim 9, wherein the instructions include determining that the barbell assembly is at a bottom of a repetition if the lift position is less than a lower threshold.

12. The controller of claim 9, wherein the instructions include determining that the lift position is increasing over a first period of time.

13. The controller of claim 12, wherein the instructions include determining that the lift position is decreasing over a second period of time different from the first period of time.

14. The controller of claim 9, wherein the instructions include executing a negative repetition as a result of predicting a decrease in the lift position and detecting that a user is at least partially supporting a weight of the barbell assembly.

15. The controller of claim 14, wherein the instructions include disengaging the electrical hoist as a result of identifying the negative repetition.

16. The controller of claim 9, wherein the instructions include outputting coaching guidance to a display screen, wherein the coaching guidance is based at least in part on performance metrics.

17. The controller of claim 9, wherein activating the electrical hoist includes activating the electrical hoist to execute an assist to negative cycle.

18. The controller of claim 9, wherein the instructions include estimating a 1-Rep Maximum value and outputting the estimated 1-Rep Maximum value to a display screen.

19. A weight training apparatus comprising:

an electrical hoist;

a cable coupled to the electrical hoist, wherein a first end of the cable is coupled to the electrical hoist and a second end is configured to attach to a barbell assembly via a tension-only member, the tension-only member being arranged to permit slack between the second end of the cable and the barbell assembly;

a sensor configured to output a signal indicative of a lift position of the barbell assembly; and a controller programmed to compare the lift position to predetermined vertical locations and activate the electrical hoist to change the lift position of the barbell assembly based at least in part on at least one of the lift position or a vertical lift velocity relative to the predetermined vertical locations, wherein the controller is programmed to detect a stall condition, the stall condition being a condition in which the lift displacement is increasing at a rate that is lower than a predetermined rate while the lift displacement is within a predetermined range; the controller is programmed to activate the electrical hoist to change the lift position of the barbell assembly as a result of determining that the lift position is between the predetermined vertical locations and as a result of detecting the stall condition.

20. The weight training apparatus of claim 19, wherein the tension-only member is arranged to permit slack between the second end of the cable and the barbell assembly while the controller receives the lift position.

* * * * *